US011695236B2

(12) United States Patent
Kanno et al.

(10) Patent No.: US 11,695,236 B2
(45) Date of Patent: Jul. 4, 2023

(54) CONNECTOR ASSEMBLY

(71) Applicant: Japan Aviation Electronics Industry, Limited, Tokyo (JP)

(72) Inventors: Hideyuki Kanno, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 52 days.

(21) Appl. No.: 17/611,703

(22) PCT Filed: Jun. 18, 2020

(86) PCT No.: PCT/JP2020/023946
§ 371 (c)(1),
(2) Date: Nov. 16, 2021

(87) PCT Pub. No.: WO2021/019941
PCT Pub. Date: Feb. 4, 2021

(65) Prior Publication Data

US 2022/0231457 A1 Jul. 21, 2022

(30) Foreign Application Priority Data

Jul. 31, 2019 (JP) ..... JP2019-140748

(51) Int. Cl.
*H01R 13/62* (2006.01)
*H01R 13/629* (2006.01)
(Continued)

(52) U.S. Cl.
CPC ..... *H01R 13/62961* (2013.01); *H01R 13/642* (2013.01); *H01R 24/005* (2013.01); *H01R 2107/00* (2013.01)

(58) Field of Classification Search
CPC . H01R 13/6296; H01R 13/642; H01R 24/005
(Continued)

(56) References Cited

U.S. PATENT DOCUMENTS 6,327,994 B1 * 12/2001 Labrador ..... B63B 39/06 114/382
6,540,532 B1 * 4/2003 Martin ..... H01R 13/62944 439/372
(Continued)

FOREIGN PATENT DOCUMENTS

DE 10 2009 028333 A1 2/2011
EP 2 816 673 A1 12/2014
(Continued)

OTHER PUBLICATIONS

European Search Report in EP 20847671.3-1201, dated May 25, 2022.
(Continued)

*Primary Examiner* — Alexander Gilman
(74) *Attorney, Agent, or Firm* — Collard & Roe, P.C.

(57) ABSTRACT

A first connector and a second connector of this connector assembly can mutually connect along the vertical direction. The first connector comprises a first housing provided with a sliding surface, a locking surface, and a receiving surface. The locking surface intersects, at an angle of 90° or less, with a line segment extending straight upward from the locking surface. The second connector comprises a second housing provided with a spring section and a locked section. The locked section can move forward and backward as the spring section elastically deforms. The locked section has a locked surface. When the second connector is in a separated state of being separated from the first connector, the locked surface intersects, at an angle of 90° or less, with a line segment extending straight upward from the locked surface. In a fitting step, the locked section moves downward while being pressed against the sliding surface. The locked section abuts the receiving surface upon moving downward on the sliding surface.

10 Claims, 12 Drawing Sheets

(51) Int. Cl.
*H01R 13/642* (2006.01)
*H01R 24/00* (2011.01)
*H01R 107/00* (2006.01)

(58) Field of Classification Search
USPC ..... 439/345
See application file for complete search history.

(56) References Cited

U.S. PATENT DOCUMENTS

| | | | | |
|---|---|---|---|---|
| 6,558,176 | B1 * | 5/2003 | Martin | H01R 13/62944 439/372 |
| 6,767,231 | B1 * | 7/2004 | Martin | H01R 13/62944 439/372 |
| 7,445,475 | B2 * | 11/2008 | Tajiri | H01R 13/62955 439/157 |
| 8,197,270 | B2 * | 6/2012 | Vasbinder | H01R 13/62977 439/157 |
| 8,414,315 | B2 * | 4/2013 | Dekoski | H01R 13/62938 439/157 |
| 8,662,906 | B2 * | 3/2014 | Schmitt | H01R 13/62955 439/372 |
| 9,178,307 | B2 * | 11/2015 | Papurcu | H01R 13/62977 |
| 9,564,701 | B2 * | 2/2017 | Hotea | H01R 13/62955 |
| 9,653,845 | B2 * | 5/2017 | Ludwig | H01R 13/62955 |
| 9,728,896 | B2 * | 8/2017 | Papurcu | H01R 13/62955 |
| 10,177,493 | B2 * | 1/2019 | Yildiz | H01R 13/62927 |
| 10,468,821 | B2 * | 11/2019 | Hirota | H01R 13/641 |
| 10,490,936 | B2 * | 11/2019 | Saitoh | H01R 13/639 |
| 10,490,938 | B2 * | 11/2019 | Probert | H01R 13/62938 |
| 10,601,177 | B1 * | 3/2020 | Probert | H01R 13/62961 |
| 10,833,452 | B2 * | 11/2020 | Loas | H01R 13/62955 |
| 2007/0197074 | A1 * | 8/2007 | Gimbel | H01R 13/62911 439/213 |
| 2014/0273565 | A1 * | 9/2014 | Papurcu | H01R 13/62944 439/153 |
| 2022/0231457 | A1 * | 7/2022 | Kanno | H01R 13/6272 |

FOREIGN PATENT DOCUMENTS

| | | | |
|---|---|---|---|
| JP | S64-002367 | U | 1/1989 |
| JP | H11-26079 | A | 1/1999 |
| JP | 2003-142184 | A | 5/2003 |
| JP | 2005-327614 | A | 11/2005 |
| JP | 2006-318845 | A | 11/2006 |
| JP | 2007-128823 | A | 5/2007 |
| JP | 2009-054518 | A | 3/2009 |
| JP | 2013-110000 | A | 6/2013 |
| WO | 2013/060772 | A1 | 5/2013 |

OTHER PUBLICATIONS

International Search Report in PCT/JP2020/023946, dated Aug. 25, 2020.
Office Action dated Aug. 19, 2020, issued in Japanese application No. 2019-140748 and its English translation (machine translation).
Decision of Refusal dated Dec. 2, 2020, issued in Japanese application No. 2019-140748 and its English translation (machine translation).
European Office Action dated Dec. 9, 2022 in European Application No. 20847671.3.

* cited by examiner

CONNECTOR ASSEMBLY

CROSS REFERENCE TO RELATED APPLICATIONS

This application is the National Stage of PCT/JP2020/023946 filed on Jun. 18, 2020, which claims priority under 35 U.S.C. § 119 of Japanese Application No. 2019-140748 filed on Jul. 31, 2019, the disclosure of which is incorporated by reference. The international application under PCT article 21(2) was not published in English.

TECHNICAL FIELD

This invention relates to a connector assembly comprising a first connector and a second connector mateable with each other.

BACKGROUND ART

For example, this type of connector assembly is disclosed in Patent Document 1.

As shown in FIG. 22, Patent Document 1 discloses a connector assembly 90 comprising a female connector (first connector) 92 and a male connector (second connector) 94. As shown in FIGS. 22 and 23, the first connector 92 is formed with an opening 922 and a pressed portion 928. The second connector 94 is provided with a bendable arm 942 which is resiliently deformable and a lock piece 944 supported by the bendable arm 942.

Referring to FIG. 23, when the second connector 94 is mated with the first connector 92, the lock piece 944 is engaged with a lock portion 926 of the opening 922. As a result, the mated state is locked, and the second connector 94 is prevented from being removed. Upon mating the second connector 94 with the first connector 92, first, the lock piece 944 is moved toward the opening 922 while being moved inward in the pitch direction (see two-dot chain line in FIG. 23). Meanwhile, the bendable arm 942 is resiliently deformed. When being moved to the opening 922, the lock piece 944 is moved outward in the pitch direction because of the resilient force of the bendable arm 942 and strikes the pressed portion 928. At that time, a click sound is produced, and the click sound indicates that the second connector 94 has been mated with the first connector 92.

PRIOR ART DOCUMENTS

Patent Document(s)

Patent Document 1: JP A 2009-54518

SUMMARY OF INVENTION

Technical Problem

For example, when each of a first connector and a second connector comprises a large number of terminals, the force required for mating becomes large. In such a case, upon mating the second connector with the first connector, the movement speed (mating speed) of the second connector tends to be slow. When the mating speed is slow, the locking piece will gently strike the pressed portion, and the click sound might be small. Therefore, there is a request to produce a large click sound even when the mating speed is slow. Moreover, there is a request to remove the second connector with no additional operation for unlocking the mated state.

It is therefore an object of the present invention to provide a connector assembly comprising a lock mechanism which produces a large click sound even when the mating speed is slow and which can unlock the mated state with no additional operation.

Solution to Problem

An aspect of the present invention provides a connector assembly comprising a first connector and a second connector. The second connector is mateable with the first connector, which is located therebelow in an upper-lower direction, along the upper-lower direction. The first connector comprises a first housing and one or more first terminals. Each of the first terminals is held by the first housing. The first housing is provided with a slide surface, a lock surface, a catch surface and a guide portion. Each of the slide surface and the catch surface extends in the upper-lower direction. The catch surface is, at least in part, located below the slide surface. The lock surface has a deep end. The deep end is located at a rear end of the lock surface in a front-rear direction perpendicular to the upper-lower direction. The lock surface faces downward and extends from the deep end toward the slide surface in the front-rear direction. The guide portion is located forward of the slide surface. The second connector comprises a second housing and one or more second terminals. Each of the second terminals is held by the second housing. The second housing is provided with a spring portion, a locked portion and a guided portion. The spring portion has a fixed portion and a support portion and is resiliently deformable. The fixed portion is fixed to a fixing portion of the second housing. The support portion is connected to the fixed portion. The locked portion projects rearward from the support portion. The support portion extends upward from the locked portion. The locked portion is movable in the front-rear direction in accordance with a resilient deformation of the spring portion. The locked portion has a locked surface. The locked surface is an upper surface of the locked portion which faces upward. The guided portion is located forward of the spring portion. In a mating process in which the second connector is mated with the first connector, the second connector is moved downward while the guided portion is guided by the guide portion. In the mating process, the locked portion slides on the slide surface to be moved downward while being pressed against the slide surface. The lock surface intersects with a line segment which extends straight upward from the lock surface by a first angle of 90 degrees or less in a perpendicular plane defined by the upper-lower direction and the front-rear direction. When the second connector is under a separated state where the second connector is separated from the first connector, the locked surface intersects with another line segment which extends straight upward from the locked surface by a second angle of 90 degrees or less in the perpendicular plane. When the locked portion is moved downward beyond the slide surface in the mating process, the locked portion is moved rearward, and a second abutment portion of the locked portion is brought into abutment with a first abutment portion of the catch surface. A first distance D11, which is a distance along the front-rear direction between the first abutment portion and the guide portion, is shorter than a second distance D21 which is another distance along the front-rear direction between the second abutment portion and the guided portion of the second connector under the separated state. Under a mated state where the first connector and the second connector are mated with each other, the locked surface is located below the lock surface, and the fixed portion of the spring portion is located forward of the lock surface.

Another aspect of the present invention provides a connector assembly comprising a first connector and a second connector. The second connector is mateable with the first connector, which is located therebelow in an upper-lower direction, along the upper-lower direction. The first connector comprises a first housing and one or more first terminals. Each of the first terminals is held by the first housing. The first housing is provided with a slide surface, a lock surface and a guide portion. The slide surface extends in the upper-lower direction. The lock surface has a deep end. The deep end is located at a rear end of the lock surface in a front-rear direction perpendicular to the upper-lower direction. The lock surface faces downward and extends from the deep end toward the slide surface in the front-rear direction. The guide portion is located forward of the slide surface. The second connector comprises a second housing and one or more second terminals. Each of the second terminals is held by the second housing. The second housing is provided with a spring portion, a locked portion and a guided portion. The spring portion has a fixed portion and a support portion and is resiliently deformable. The fixed portion is fixed to a fixing portion of the second housing. The support portion is connected to the fixed portion. The locked portion projects rearward from the support portion. The support portion extends upward from the locked portion. The locked portion is movable in the front-rear direction in accordance with a resilient deformation of the spring portion. The locked portion has a locked surface. The locked surface is an upper surface of the locked portion which faces upward. The guided portion is located forward of the spring portion. In a mating process in which the second connector is mated with the first connector, the second connector is moved downward while the guided portion is guided by the guide portion. In the mating process, the locked portion slides on the slide surface to be moved downward while being pressed against the slide surface. The lock surface intersects with a line segment which extends straight upward from the lock surface by a first angle of 90 degrees or less in a perpendicular plane defined by the upper-lower direction and the front-rear direction. When the second connector is under a separated state where the second connector is separated from the first connector, the locked surface intersects with another line segment which extends straight upward from the locked surface by a second angle of 90 degrees or less in the perpendicular plane. When the locked portion is moved downward beyond the slide surface in the mating process, the locked portion is moved rearward, and a second abutment portion of the locked portion is brought into abutment with a first abutment portion of the slide surface. A first other distance D12, which is a distance along the front-rear direction between the first abutment portion and the guide portion, is shorter than a second other distance D22 which is a distance along the front-rear direction between the second abutment portion and the guided portion of the second connector under the separated state. Under a mated state where the first connector and the second connector are mated with each other, the locked surface is located below the lock surface, and the fixed portion of the spring portion is located forward of the lock surface.

Advantageous Effects of Invention

In the mating process of the connector assembly of the present invention, the locked portion supported by the resiliently deformable support portion slides on the slide surface to be moved downward while being pressed against the slide surface. In the present invention, each of the first angle, by which the lock surface intersects with the upper-lower direction, and the second angle, by which the locked surface of the locked portion intersects with the upper-lower direction, is 90 degrees or less. Moreover, in the present invention, the locked portion is arranged at a position so as to be brought into abutment with the catch portion, or the support portion of the spring portion is arranged at a position so as to be brought into abutment with the slide surface. According to the aforementioned structure, even when the mating speed in the mating process is slow, the locked portion is rapidly moved rearward, and the locked portion (support portion) strikes the catch surface (slide surface) at high speed. As a result, a large click sound is produced even when the mating speed is slow.

In addition, according to the present invention, the locked surface is located below the lock surface under the mated state, and thereby the mated state is locked. However, under the mated state, the support portion of the spring portion extends from the fixed portion, which is located forward of the lock surface, to the locked portion which is located below the lock surface. The thus-cantilevered support portion has a fulcrum which is located above and forward of the locked surface. When the second connector is pulled upward, the locked surface receives an upward force from the lock surface, and thereby a forward moment about the fulcrum of the support portion is applied to the spring portion. As a result, the locked portion is moved forward, and thereby the mated state is unlocked. Thus, according to the present invention, the mated state can be unlocked only by pulling the second connector upward.

As described above, the present invention provides a connector assembly comprising a lock mechanism which produces a large click sound even when the mating speed is slow and which enables the mated state to be unlocked with no additional operation.

An appreciation of the objectives of the present invention and a more complete understanding of its structure may be had by studying the following description of the preferred embodiment and by referring to the accompanying drawings.

DESCRIPTION OF EMBODIMENTS

Figure 1:
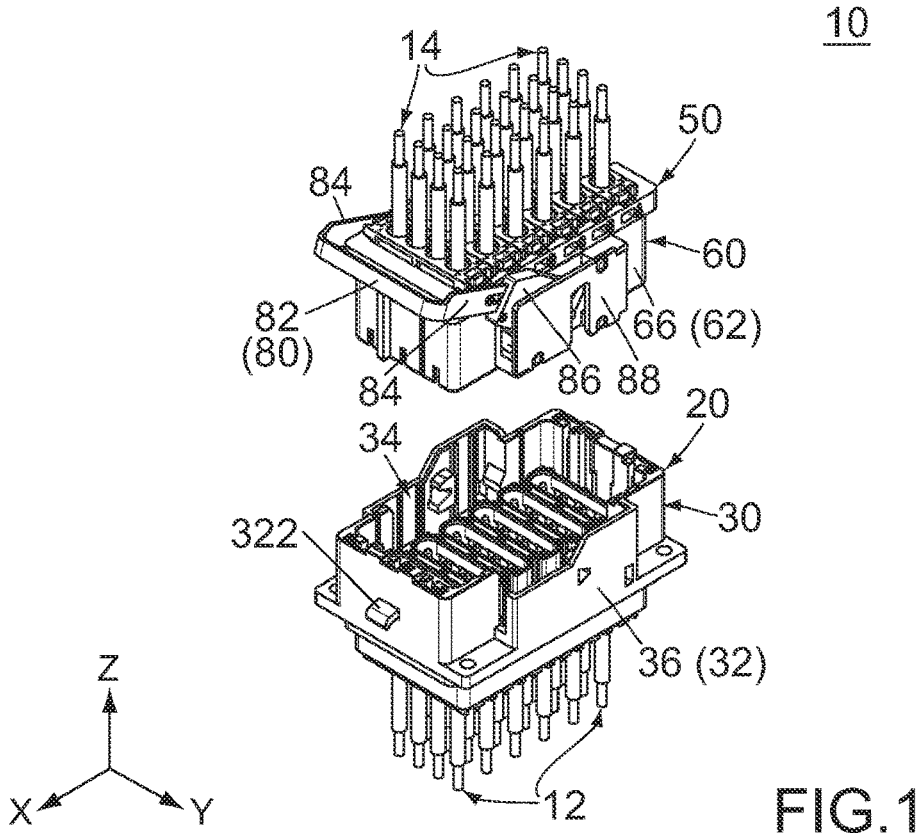
FIG. 1 is a perspective view showing a connector assembly according to an embodiment of the present invention, wherein a first connector and a second connector of the connector assembly are under a separated state where they are separated from each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 2:
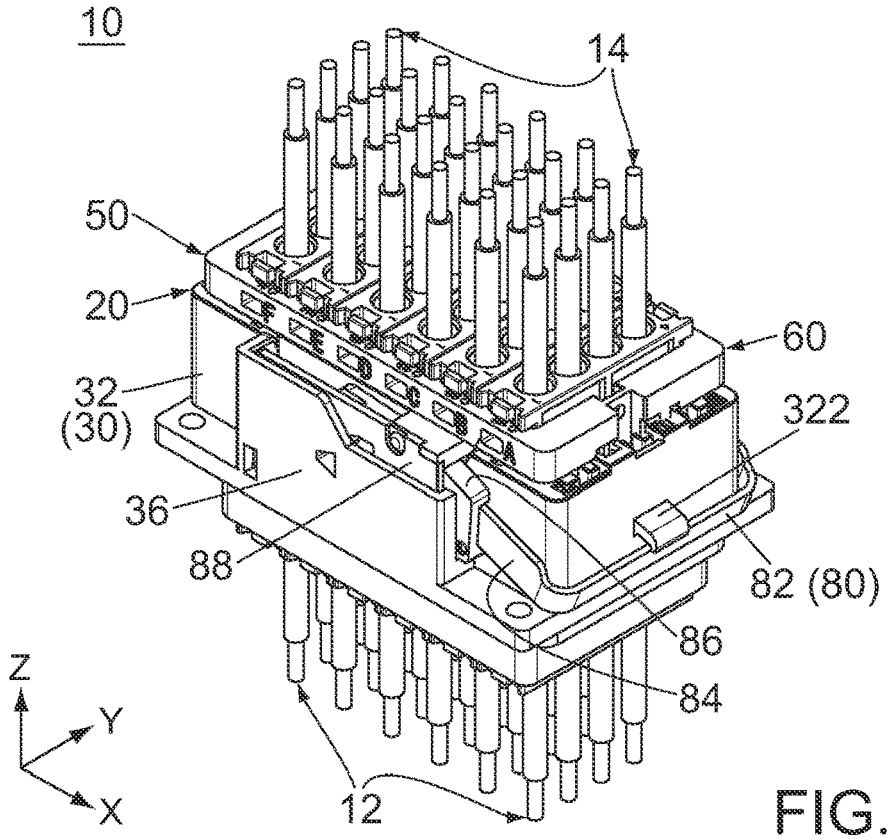
FIG. 2 is a perspective view showing the connector assembly of FIG. 1, wherein the first connector and the second connector are under a mated state where they are mated with each other.

As shown in FIGS. 1 and 2, a connector assembly 10 of the present embodiment comprises a first connector 20 and a second connector 50. In the present embodiment, the first connector 20 is a receptacle, and the second connector 50 is a plug. Moreover, the first connector 20 is a cable connector which is connected to a plurality of first cables 12 when used, and the second connector 50 is another cable connector which is connected to a plurality of second cables 14 when used. However, the present invention is not limited thereto. For example, the first connector 20 may be a plug, and the second connector 50 may be a receptacle. Moreover, each of the first connector 20 and the second connector 50 is not limited to a cable connector.

The first connector 20 and the second connector 50 are mateable with each other along an upper-lower direction (Z-direction: mating direction). More specifically, the second connector 50 is mateable with the first connector 20 along the Z-direction, wherein the first connector 20 is located therebelow in the Z-direction or faces the negative Z-side of the second connector 50. The second connector 50 which is mated with the first connector 20 is removable from the first connector 20 along the Z-direction.

Figure 4:
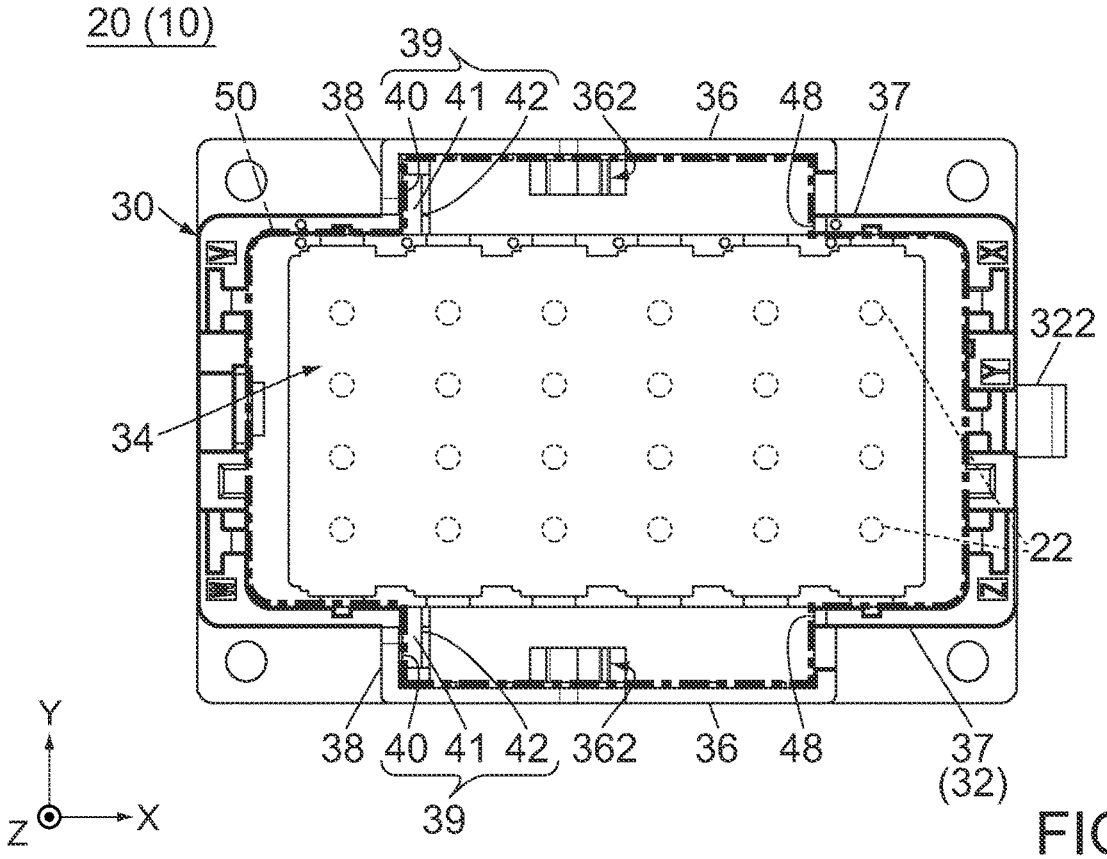
FIG. 4 is a top view showing the first connector of FIG. 3, wherein positions of the first terminals are illustrated with dashed line, and a rough outline of a part of the second connector which is received in a receiving space of the first connector is illustrated with chain dotted lines.

Referring to FIGS. 1, 2 and 4, the first connector 20 of the present embodiment comprises a first housing 30 made of insulator and a plurality of first terminals 22 each made of conductor. Each of the first terminals 22 is held by the first housing 30. In the present embodiment, the first terminals 22 are connected to the first cables 12, respectively, when the first connector 20 is used. Referring to FIG. 4, the number of the first terminals 22 of the present embodiment is twenty four. However, the present invention is not limited thereto, but the first connector 20 should comprise one or more of the first terminals 22.

Figure 5:
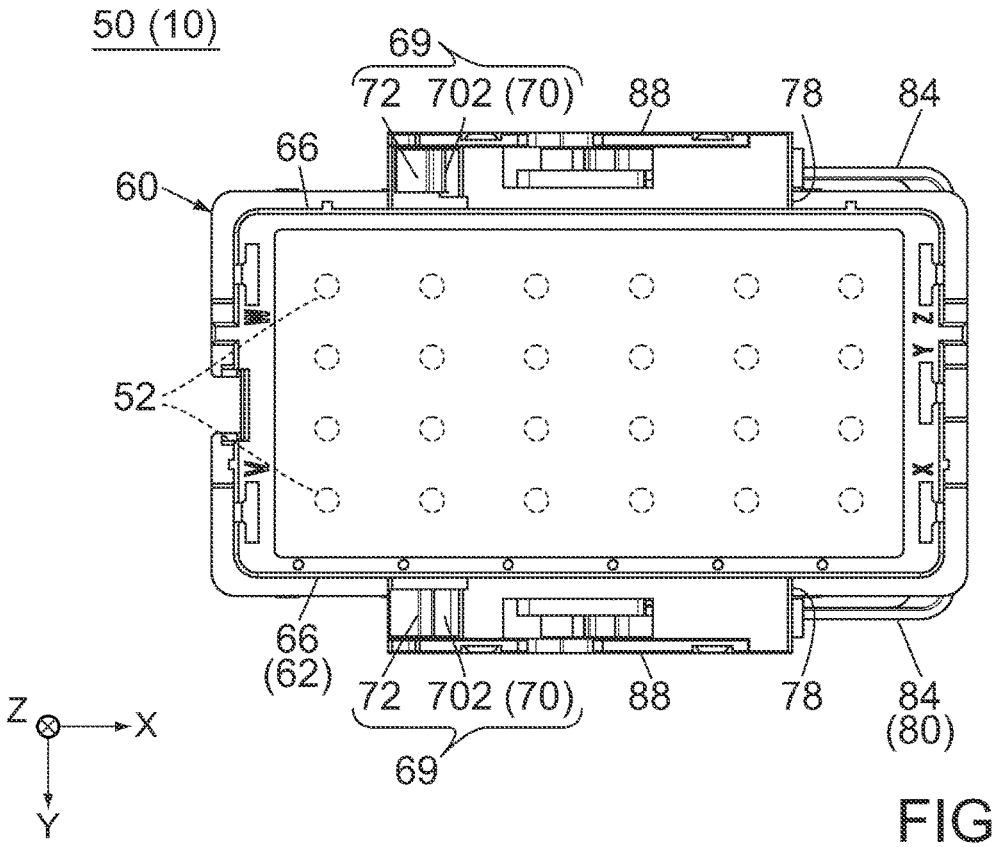
FIG. 5 is a bottom view showing the second connector of FIG. 3, wherein positions of the second terminals are illustrated with dashed line.

Referring to FIGS. 1, 2 and 5, the second connector 50 of the present embodiment comprises a second housing 60 made of insulator and a plurality of second terminals 52 each of which is made of conductor and which correspond to the first terminals 22 (see FIG. 4), respectively. Each of the second terminals 52 is held by the second housing 60. In the present embodiment, the second terminals 52 are connected to the second cables 14, respectively, when the second connector 50 is used. Referring to FIG. 5, the number of the second terminals 52 of the present embodiment is twenty four. However, the present invention is not limited thereto, but the second connector 50 should comprise one or more of the second terminals 52.

Figure 3:
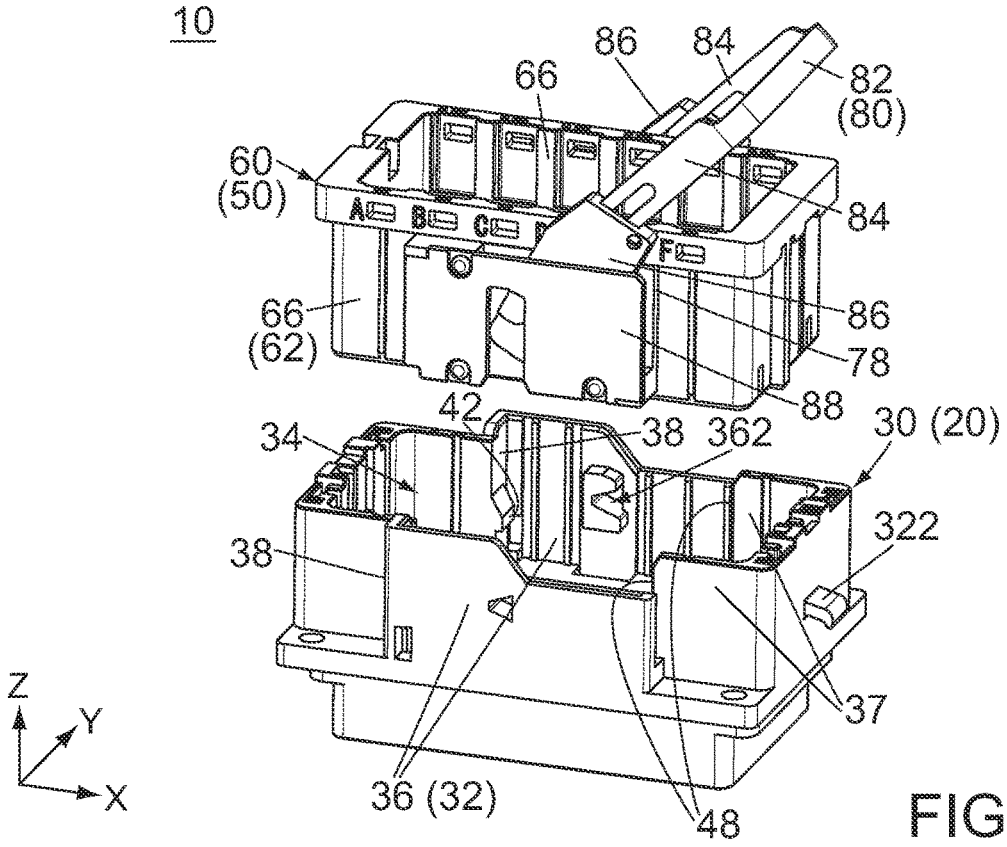
FIG. 3 is a perspective view showing the connector assembly of FIG. 1, wherein first terminals of the first connector and a part which holds the first terminals are not illustrated, and second terminals of the second connector and a part which holds the second terminals are not illustrated.

As shown in FIGS. 3 and 5, the second housing 60 of the present embodiment has a second peripheral wall 62. The second peripheral wall 62 has a rectangular frame-like shape in a horizontal plane (XY-plane) perpendicular to the Z-direction so as to have two second side walls 66. The second side walls 66 are located at opposite sides of the second peripheral wall 62, respectively, in a lateral direction (Y-direction) perpendicular to the Z-direction. Each of the second side walls 66 extends along a perpendicular plane (XZ-plane) perpendicular to the Y-direction. The second housing 60 of the present embodiment has the aforementioned structure. However, the present invention is not limited thereto, but the structure of the second housing 60 can be variously modified.

Figure 7:
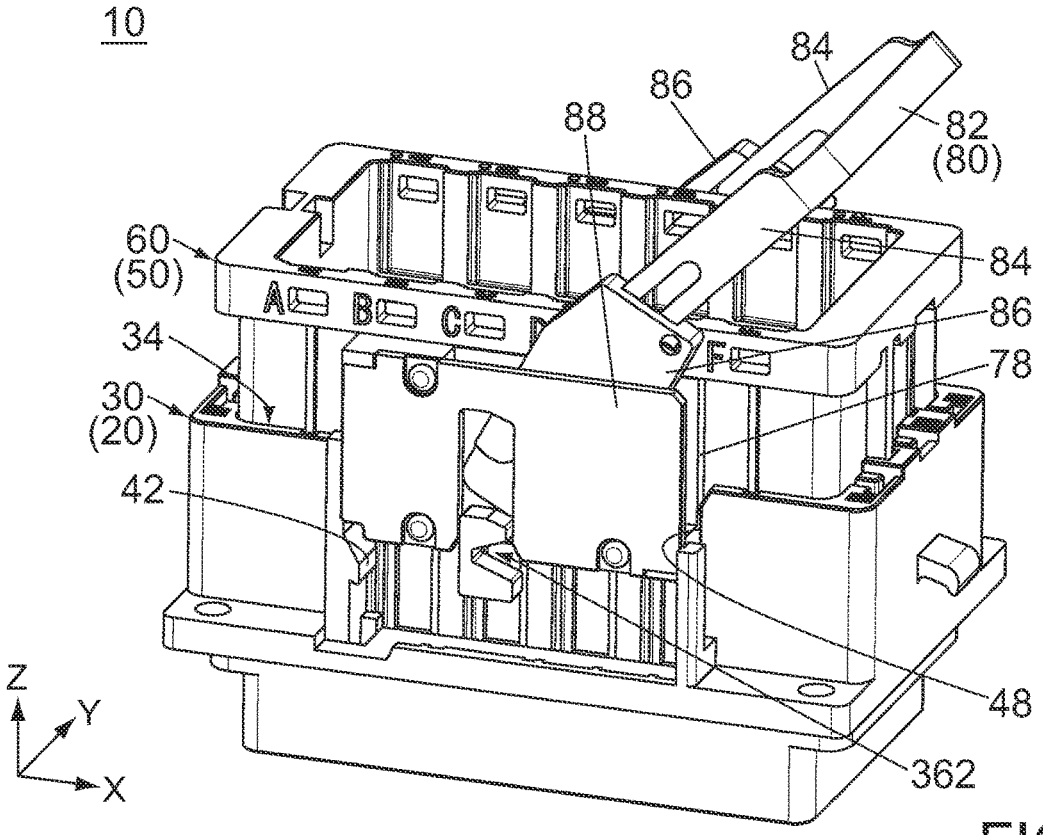
FIG. 7 is a perspective view showing the connector assembly of FIG. 3, wherein the second connector is partially received in the receiving space of the first connector, and a first protruding wall of the first housing is not illustrated.
Figure 8:
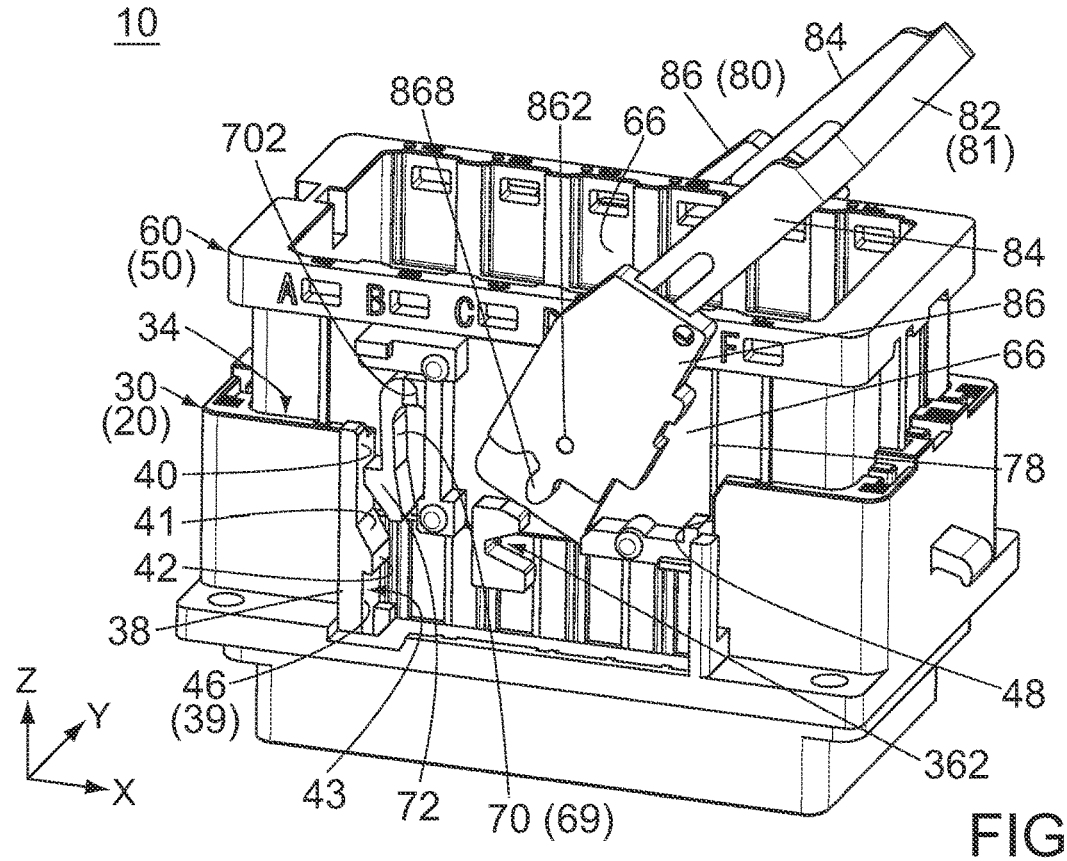
FIG. 8 is a perspective view showing the connector assembly of FIG. 7, wherein a cover of the second connector is not illustrated.

Referring to FIGS. 1 and 7, the second connector 50 of the present embodiment comprises a lever 80 and two covers 88 each made of insulator in addition to the second housing 60 and the second terminals 52 (see FIG. 5). Referring to FIG. 8, the lever 80 comprises an operation member 81 made of metal and two operated members 86 each made of insulator. The operation member 81 has an operation portion 82 and two arms 84 which correspond to the operated members 86, respectively. The operation portion 82 extends along the Y-direction. The arms 84 linearly extend from opposite ends of the operation portion 82 in the Y-direction, respectively. Each of the arms 84 has an end attached to the corresponding operated member 86.

Each of the operated members 86 has a rotation axis 862 and a projecting portion 868. The operated members 86 correspond to the second side walls 66 of the second housing 60, respectively. Each of the operated members 86 is attached to an outside surface of the corresponding second side wall 66 in the Y-direction so as to extend along the XZ-plane. Each of the operated members 86 is turnable about the rotation axis 862 in the XZ-plane. Each of the projecting portions 868 projects from the operated member 86 so as to be away from the operation member 81. Referring to FIGS. 7 and 8, the covers 88 are attached to the outside surfaces of the second side walls 66 in the Y-direction, respectively, so as to cover the operated members 86 from its outer side in the Y-direction.

The second connector 50 of the present embodiment comprises the lever 80 and the covers 88 which are attached to the second housing 60 as described above. The illustrated lever 80 extends upward, or along the positive Z-direction, from the second housing 60 and extends forward, or along the positive X-direction, from the second housing 60 in a front-rear direction (X-direction) perpendicular to both the Y-direction and the Z-direction. As described later, the first connector 20 and the second connector 50 are mateable with each other by operating the lever 80. However, the present invention is not limited thereto, but the lever 80 and the covers 88 may be provided as necessary.

As shown in FIG. 3, the first housing 30 of the present embodiment has a first peripheral wall 32 and a receiving space 34. The first peripheral wall 32 encloses the receiving space 34 in the XY-plane. In other words, the receiving space 34 is a space which is enclosed by the first peripheral wall 32 in the XY-plane. The first peripheral wall 32 of the present embodiment is provided with a lever stopper 322 which is configured to hook the lever 80. The lever stopper 322 projects forward from the first peripheral wall 32.

Referring to FIGS. 3 and 4, the first peripheral wall 32 has a rectangular frame-like shape in the XY-plane so as to have two first protruding walls 36, two first side walls 37 and two first rear walls 38. Each of the first side walls 37 is a side wall which is located at a front side (positive X-side) of the first peripheral wall 32. The first side walls 37 are located at opposite sides of the first peripheral wall 32 in the Y-direction, respectively. Each of the first side walls 37 extends along the perpendicular plane (XZ-plane) defined by the X-direction and the Z-direction. The first protruding walls 36 correspond to the first side walls 37, respectively. Each of the first protruding walls 36 is located at the middle of the first peripheral wall 32 in the X-direction. Each of the first protruding walls 36 is located rearward, or at the negative X-side, of the corresponding first side wall 37 and outward of the corresponding first side wall 37 in the Y-direction, and extends along the XZ-plane. The first rear walls 38 correspond to the first protruding walls 36, respectively. Each of the first rear walls 38 is located at a rear end (negative X-side end) of the corresponding first protruding wall 36 and extends along a predetermined plane defined by the Y-direction and the Z-direction.

Referring to FIGS. 3 and 8, the first housing 30 of the present embodiment has two lever receiving portions 362 which correspond to the operated members 86 of the lever 80, respectively. The lever receiving portions 362 correspond to the first protruding walls 36, respectively. Each of the lever receiving portions 362 is provided on an inside surface of the corresponding first protruding wall 36 in the Y-direction and protrudes inward in the Y-direction. Thus, each of the lever receiving portions 362 is located in the receiving space 34. Referring to FIG. 8, each of the lever receiving portions 362 has a recess which can receive the projecting portion 868 of the corresponding operated member 86. The recess of each of the lever receiving portions 362 opens forward.

The first housing 30 of the present embodiment has the aforementioned structure. However, the present invention is not limited thereto, but the structure of the first housing 30 can be variously modified. For example, when the second connector 50 does not comprise the lever 80, the lever stopper 322 and the lever receiving portions 362 do not need to be provided.

Referring to FIGS. 3 and 7, in the present embodiment, the receiving space 34 of the first connector 20 has a shape which can receive the second peripheral wall 62 of the second connector 50 together with the operated members 86 and the covers 88. In detail, referring to FIGS. 4 and 5, the receiving space 34 has a shape in the XY-plane which is substantially identical to another shape of a lower part (negative Z-side part) of the second connector 50 in the XY-plane. In particular, the receiving space 34 has a size in the X-direction which is slightly larger than another size of the lower part of the second connector 50 in the X-direction, and the receiving space 34 has a size in the Y-direction which is slightly larger than another size of the lower part of the second connector 50 in the Y-direction.

Figure 10:
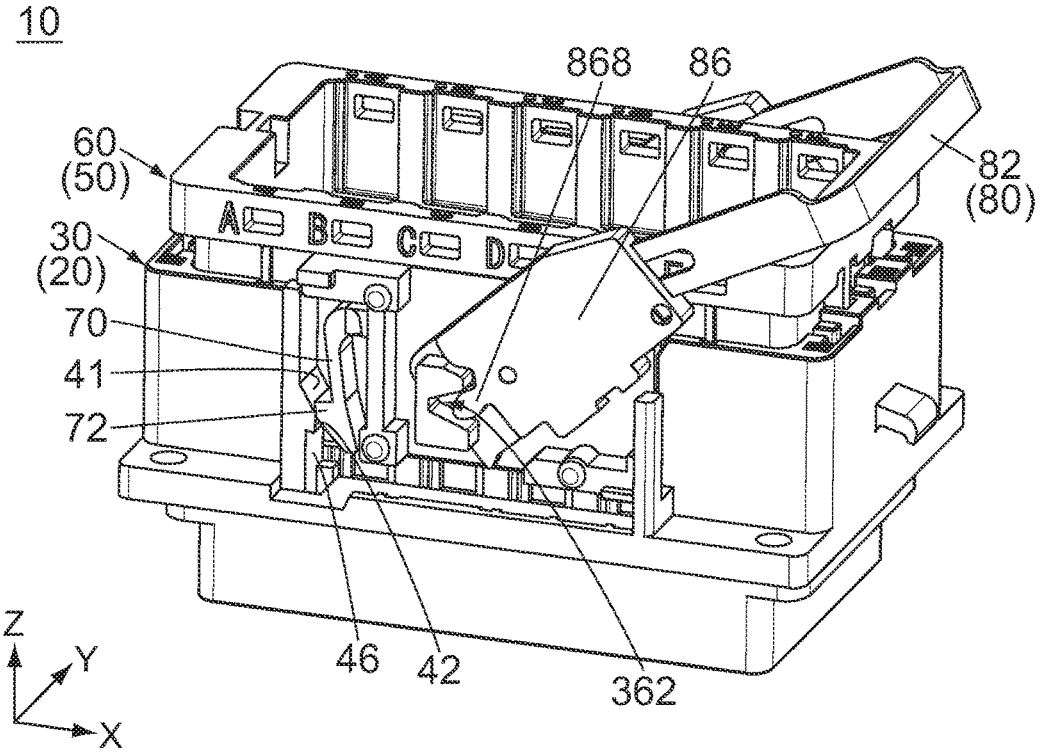
FIG. 10 is a perspective view showing the connector assembly of FIG. 8, wherein a projecting portion of the lever is partially received in a lever receiving portion of the first housing.
Figure 13:
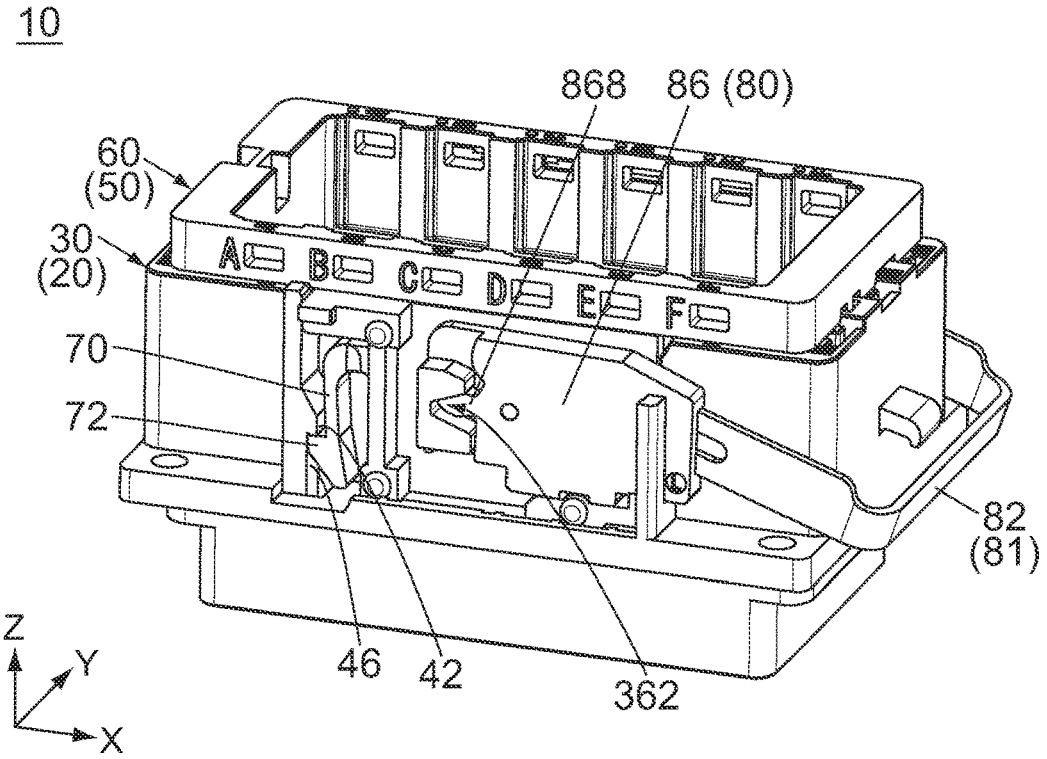
FIG. 13 is a perspective view showing the connector assembly of FIG. 10, wherein the second connector is mated with the first connector, and the mated state is locked.

Referring to FIGS. 3 and 7, upon mating the second connector 50 with the first connector 20, first, the second connector 50 is moved downward, and the second peripheral wall 62 of the second connector 50 is inserted into the receiving space 34 of the first connector 20 together with the operated members 86 and the covers 88. Referring to FIGS. 8 and 10, then, the second connector 50 is further moved downward, and the projecting portions 868 of the operated members 86 are inserted into the recesses of the lever receiving portions 362, respectively. Referring to FIGS. 10 and 13, then, the operation portion 82 of the lever 80 is pushed down. When the operation portion 82 is pushed down, the second connector 50 is further moved downward, and thereby the first connector 20 and the second connector 50 are mated with each other.

Referring to FIG. 2, under a mated state where the first connector 20 and the second connector 50 are mated with each other, each of the first terminals 22 (see FIG. 4) is brought into contact with the corresponding second terminal 52 (see FIG. 5), and thereby the first cables 12 are electrically connected with the second cables 14, respectively.

Referring to FIGS. 10 and 13, upon removing the second connector 50 which is under the mated state from the first connector 20, first, the operation portion 82 of the lever 80 is pulled up. When the operation portion 82 is pulled up, the second connector 50 is moved upward. Meanwhile, each of the second terminals 52 (see FIG. 5) is separated from the corresponding first terminal 22 (see FIG. 4). Referring to FIGS. 8 and 10, then, the second connector 50 is lifted up, and the projecting portions 868 of the operated members 86 are removed from the recesses of the lever receiving portions 362, respectively. Referring to FIGS. 3 and 7, then, the second connector 50 is further moved upward, and the second peripheral wall 62 of the second connector 50 is removed from the receiving space 34 of the first connector 20 together with the operated members 86 and the covers 88. As a result, the second connector 50 takes a separated state where the second connector 50 is separated from the first connector 20.

In general, when the number of the first terminals 22 (see FIG. 4) is large, a large force is required in order for the second terminals 52 (see FIG. 5) to be brought into contact with the first terminals 22, respectively. A large force is also required in order for the second terminals 52 to be separated from the first terminals 22, respectively. Thus, when each of the first connector 20 and the second connector 50 is a multi-contact connector such as that of the present embodiment, a large force is usually required in each of a mating process in which the second connector 50 is mated with the first connector 20 and a removing process in which the second connector 50 is removed from the first connector 20. Moreover, even when the number of the first terminals 22 is one, a large force is required in each of the mating process and the removing process depending on the size of the first terminal 22.

In contrast, according to the present embodiment, the second connector 50 can be mated with the first connector 20 by operating the lever 80 with a relatively small force. In addition, the second connector 50 can be removed from the first connector 20 by operating the lever 80 with a relatively small force. However, the present invention is not limited thereto. For example, the second connector 50 may be directly pushed down to be mated with the first connector 20 without providing the lever 80. Similarly, the second connector 50 may be directly pulled up to be removed from the first connector 20.

Figure 15:
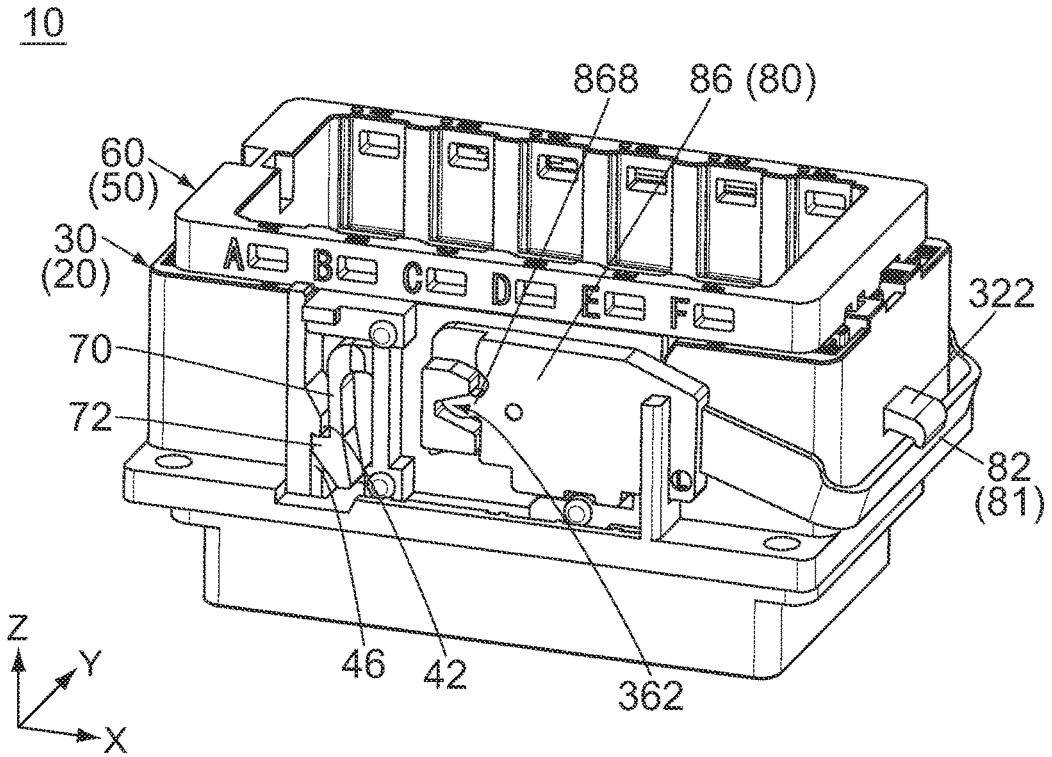
FIG. 15 is a perspective view showing the connector assembly of FIG. 13, wherein the lever is hooked on a lever stopper of the first connector.

Referring to FIGS. 13 and 15, in the present embodiment, the operation member 81 of the lever 80 is attached so as to be movable relative to the operated members 86. When the second connector 50 is under the mated state, the operation member 81 can be moved rearward from the operated members 86, and thereafter the operation portion 82 can be hooked on the lever stopper 322 of the first connector 20. By hooking the operation portion 82 on the lever stopper 322, the mated state can be prevented from being unlocked even when an unintentional force is applied to the operation portion 82. However, the operation portion 82 may be hooked on the lever stopper 322 as necessary.

Referring to FIGS. 3 and 4, the first housing 30 is provided with two guide portions 48. In the present embodiment, each of the guide portions 48 is a rear edge surface of the first side wall 37 of the first housing 30 and extends along the YZ-plane. Thus, each of the guide portions 48 is a flat surface which faces rearward and extends along the Z-direction.

Referring to FIGS. 3 and 5, the second housing 60 is provided with two guided portions 78 which correspond to the guide portions 48, respectively. In the present embodiment, each of the guided portions 78 is a front edge surface (positive X-side surface) of a part of the second housing 60 which protrudes outward from the second side wall 66, and each of the guided portions 78 extends along the YZ-plane. Thus, each of the guided portions 78 is a flat surface which faces forward and extends along the Z-direction.

Referring to FIG. 7, the guided portions 78 are formed at positions which correspond to those of the guide portions 48, respectively. More specifically, when the second connector 50 is partially inserted into the receiving space 34 of the first connector 20, each of the guided portions 78 is located rearward of the corresponding guide portion 48 with a slight distance from the corresponding guide portion 48 or is arranged to be in contact with the corresponding guide portion 48. Moreover, the receiving space 34 has a size in the X-direction which is substantially equal to another size of the second peripheral wall 62 of the second connector 50 in the X-direction. Therefore, a distance between each of the guided portions 78 and the corresponding guide portion 48 in the X-direction is hardly changed during the mating process in which the second connector 50 is mated with the first connector 20.

During the mating process of the second connector 50, the guide portions 48 and the guided portions 78 which are arranged as described above prevent a movement of the second connector 50 in the X-direction and enable the second connector 50 to be reliably moved downward. In other words, in the mating process, the second connector 50 is moved downward while the guided portions 78 are guided by the guide portions 48.

Figure 6:
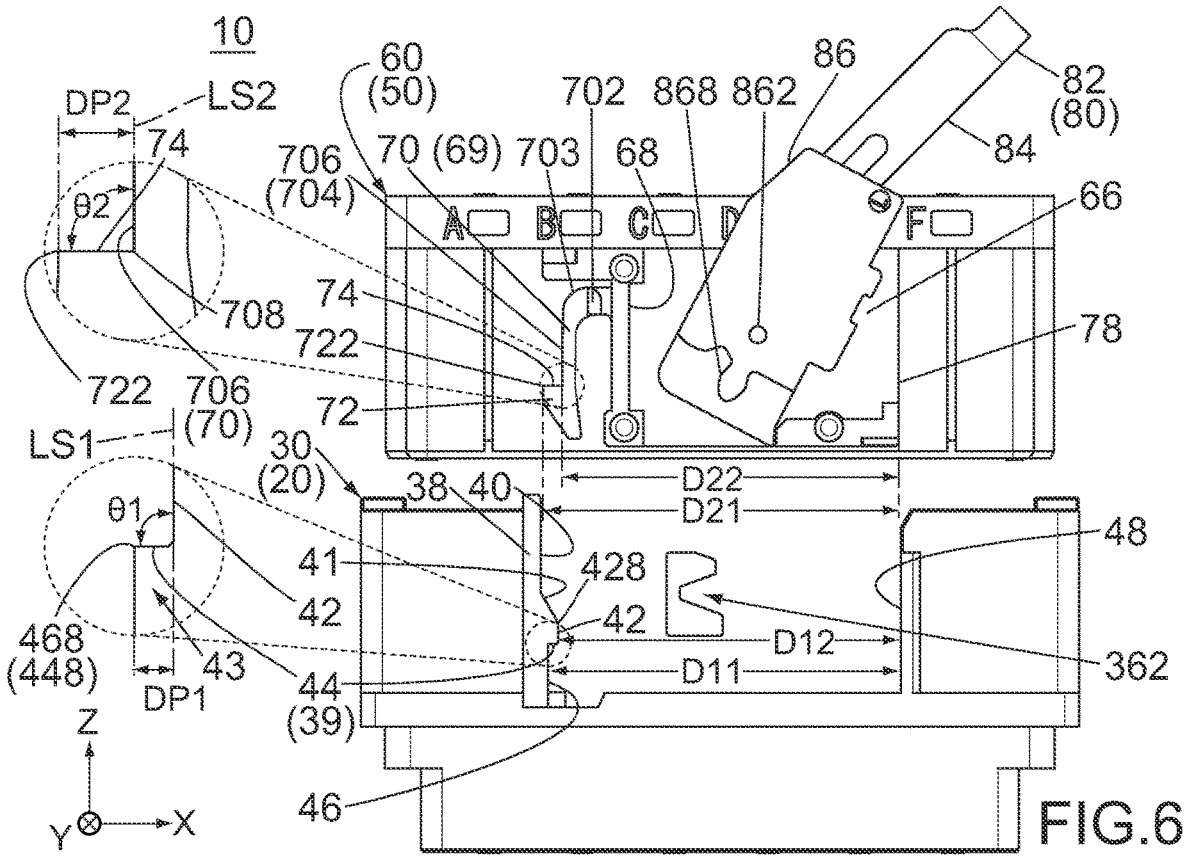
FIG. 6 is a side view showing the connector assembly of FIG. 3, wherein a part of a first housing is illustrated, a part of a second housing and a lever are illustrated, and a part of the first connector enclosed by dashed line and a part of the second connector enclosed by dashed line are enlarged and illustrated.

Referring to FIGS. 4 and 5, according to the present embodiment, the two guide portions 48 are located at positions same as each other in the X-direction, and the two guided portions 78 are located at positions same as each other in the X-direction. Referring to FIG. 6, each of the guide portions 48 and the guided portions 78 continuously and linearly extends along the Z-direction. Each of the guided portions 78 is located just in front of the corresponding guide portion 48. However, the present invention is not limited thereto. The structure, number and arrangement of the guide portions 48 can be variously modified, provided that the position of each of the guided portions 78 in the X-direction is substantially equal to the position of the corresponding guide portion 48 in the X-direction during the mating process of the second connector 50. Similarly, the structure, number and arrangement of the guided portion 78 can be variously modified. For example, each of the guided portions 78 may be located just behind the corresponding guide portion 48.

Referring to FIGS. 4 and 6, the first connector 20 of the present embodiment has two first lock structures 39. The first lock structures 39 are located at opposite sides of the first housing 30 in the Y-direction, respectively, and are located at positions same as each other in the X-direction. Referring to FIGS. 4, 5 and 6, the second connector 50 of the present embodiment has two second lock structures 69 which correspond to the first lock structures 39, respectively.

The second lock structures 69 are located at opposite sides of the second housing 60 in the Y-direction, respectively, and are located at positions same as each other in the X-direction. Thus, the connector assembly 10 of the present embodiment comprises two sets each of which consists of the first lock structure 39 and the second lock structure 69 corresponding to each other.

In the present embodiment, the two sets of the first lock structures 39 and the second lock structures 69 have structures similar to each other and similarly lock the mated state of the first connector 20 and the second connector 50. Thus, the two sets of the first lock structures 39 and the second lock structures 69 work as a lock mechanism of the connector assembly 10. However, the present invention is not limited thereto. For example, the two sets of the first lock structures 39 and the second lock structures 69 may have structures different from each other. The number of the sets of the first lock structures 39 and the second lock structures 69 is not limited to two but may be one or may be three or more. However, the present embodiment is preferable from a viewpoint of securely locking the mated state without excessively complicating the structure of the connector assembly 10. Hereafter, explanation will be made about one set of the first lock structure 39 and the second lock structure 69 corresponding to each other. The explanation described below is applicable to each set.

Referring to FIG. 4, in the present embodiment, the first lock structure 39 is a front part of the first rear wall 38 of the first housing 30. Referring to FIGS. 6 and 8, the first lock structure 39 includes a facing surface 40, a sloping surface 41, a slide surface 42, a receiving recess 43, a lock surface (upper wall surface) 44 and a catch surface (rear wall surface) 46. Thus, the first housing 30 is provided with the facing surface 40, the sloping surface 41, the slide surface 42, the receiving recess 43, the lock surface 44 and the catch surface 46.

The facing surface 40 is formed on an upper part (positive Z-side part) of the first rear wall 38. The facing surface 40 faces forward and extends along the Z-direction. The sloping surface 41 faces forward and extends from a lower end (negative Z-side end) of the facing surface 40 to the slide surface 42 while sloping forward and downward. The slide surface 42 has an upper end 428 and faces forward. In particular, the slide surface 42 of the present embodiment extends straight along the Z-direction from the upper end 428. Thus, the slide surface 42 of the present embodiment is a flat surface perpendicular to the X-direction. However, the shape of the slide surface 42 is not limited to that of the present embodiment, provided that the slide surface 42 extends in the Z-direction. For example, the slide surface 42 may be a flat surface oblique to the X-direction or may be a curved surface intersecting with the X-direction.

The receiving recess 43 is a recess which is recessed rearward from the slide surface 42. The catch surface 46 is the rear wall surface of the receiving recess 43. Thus, the catch surface 46 is located below the slide surface 42 and faces forward. The catch surface 46 has an upper end 468. The catch surface 46 of the present embodiment is located rearward of the slide surface 42 in the X-direction and extends straight downward from the upper end 468 along the Z-direction. Thus, the catch surface 46 is a flat surface perpendicular to the X-direction. However, the shape of the catch surface 46 is not limited to that of the present embodiment, provided that the catch surface 46 extends in the Z-direction. For example, the catch surface 46 may be a flat surface oblique to the X-direction or may be a curved surface intersecting with the X-direction.

The lock surface 44 is an upper wall surface of the receiving recess 43. The lock surface 44 has a deep end 448. The deep end 448 is located at a rear end of the lock surface 44 in the X-direction. The lock surface 44 faces downward and extends from the deep end 448 toward the slide surface 42 in the X-direction. In the present embodiment, the deep end 448 is located at a position same as that of the upper end 468 of the catch surface 46. Thus, the lock surface 44 of the present embodiment is located between the slide surface 42 and the catch surface 46 in the X-direction and extends from the upper end 468 of the catch surface 46 toward the slide surface 42.

Referring to FIG. 5, in the present embodiment, the second lock structure 69 is provided to be located outward of the second side wall 66 of the second housing 60 in the Y-direction. Referring to FIGS. 6 and 8, the second lock structure 69 includes a spring portion 70 and a locked portion 72. Thus, the second housing 60 is provided with the spring portion 70 and the locked portion 72.

Referring to FIG. 6, the spring portion 70 has a fixed portion 702 and a support portion 704. The fixed portion 702 is fixed to the second housing 60. In detail, the second side wall 66 of the second housing 60 is formed with a fixing portion 68 which protrudes outward in the Y-direction. The fixed portion 702 is fixed to the fixing portion 68 of the second housing 60. The support portion 704 is connected to the fixed portion 702. The spring portion 70 which is formed as described above is resiliently deformable.

According to the present embodiment, when the second connector 50 is under the separated state, the fixed portion 702 extends rearward from the fixing portion 68, and the support portion 704 extends long downward from a rear end 703 of the fixed portion 702. Thus, the spring portion 70 has an L-like shape in the XZ-plane and extends downward from the fixing portion 68 as a whole. The spring portion 70 which is formed as described above is resiliently deformable easily as a whole. However, the present invention is not limited thereto; and the shape of the spring portion 70 is not specifically limited, provided that the spring portion 70 is resiliently deformable. For example, the fixed portion 702 may be an edge surface of the spring portion 70, and the support portion 704 may extend rearward and downward from the fixed portion 702.

The support portion 704 has a support surface 706 and a lower end 708. The support surface 706 is a rear edge surface of the support portion 704. The support surface 706 faces rearward and extends along the Z-direction. The lower end 708 is a lower end of the support surface 706.

The locked portion 72 is provided on a lower end of the support portion 704. In other word, the support portion 704 extends upward from the locked portion 72. The thus-provided locked portion 72 is movable in the X-direction in accordance with a resilient deformation of the spring portion 70. The locked portion 72 projects rearward from the support portion 704. The locked portion 72 has a hook-like shape and has a locked surface (upper surface) 74 and a leading edge 722 in the X-direction. The locked surface 74 is an upper surface of the locked portion 72 which faces upward. When the second connector 50 is under the separated state, the spring portion 70 is not resiliently deformed, i.e., it is not bent, and the locked surface 74 projects rearward from the support surface 706 to the leading edge 722.

Figure 9:
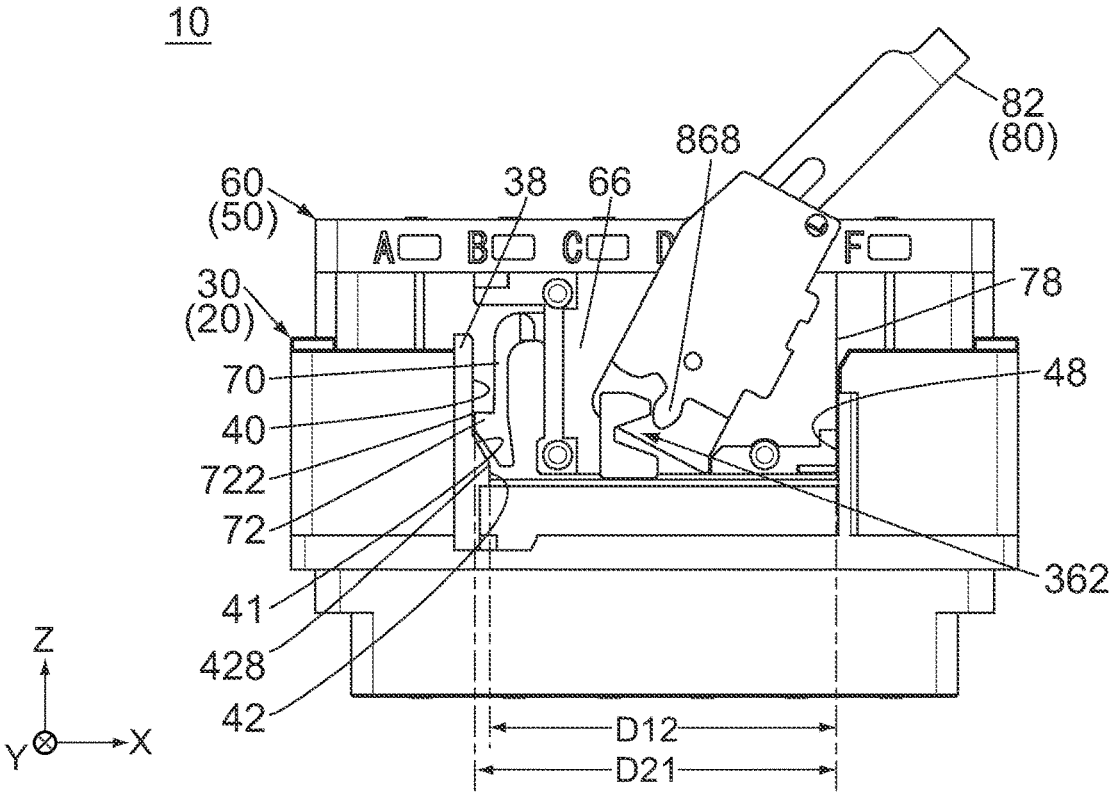
FIG. 9 is a side view showing the connector assembly of FIG. 6, wherein the second connector is partially received in the receiving space of the first connector.

Referring to FIGS. 8 and 9, when the second connector 50 is partially inserted into the receiving space 34 of the first connector 20 in the mating process, the spring portion 70 and the locked portion 72 are located forward of the facing surface 40 while being apart from the facing surface 40. In other words, the facing surface 40 faces the spring portion 70 and the locked portion 72 in the X-direction. The spring portion 70 under this state is not resiliently deformed.

Referring to FIG. 9, in the first connector 20, the guide portion 48 is apart from the slide surface 42 and is located forward of the slide surface 42. In the second connector 50, the guided portion 78 is apart from the spring portion 70 and is located forward of the spring portion 70. Moreover, as previously described, in the connector assembly 10 during the mating process, the position of the guided portion 78 in the X-direction can be considered to be equal to the position of the guide portion 48 in the X-direction.

Referring to FIG. 6, according to the present embodiment, in the second connector 50 which is under the separated state, i.e., a state where the spring portion 70 is not resiliently deformed, the support surface 706 of the spring portion 70 is a flat surface perpendicular to the X-direction, and the leading edge 722 of the locked portion 72 is located at a rear end of the locked portion 72. Under the separated state, a distance between the leading edge 722 and the guided portion 78 along the X-direction is a second distance D21, and a distance between the support surface 706 and the guided portion 78 along the X-direction is a second other distance D22. In the first connector 20 of the present embodiment, each of the slide surface 42 and the catch surface 46 is a flat surface perpendicular to the X-direction. A distance between the catch surface 46 and the guide portion 48 along the X-direction is a first distance D11, and a distance between the slide surface 42 and the guide portion 48 along the X-direction is a first other distance D12.

Referring to FIG. 9, the second distance D21 is larger than the first other distance D12. Thus, under a state shown in FIG. 9, the leading edge 722 of the locked portion 72 is located rearward of the upper end 428 of the slide surface 42. As can be seen from FIG. 9, when the second connector 50 is further moved downward in the mating process, the locked portion 72 is brought into contact with the sloping surface 41 because of the positional relation described above. When the second connector 50 is further moved downward, the locked portion 72 gradually resiliently deforms the spring portion 70 while sliding on the sloping surface 41 to be moved downward. When the spring portion 70 is resiliently deformed, the second side wall 66 of the second connector 50 receives a forward force. As a result, the guided portion 78 is prevented from being moved to be away from the corresponding guide portion 48 in the X-direction.

In the present embodiment, the facing surface 40 is a flat surface in parallel to the YZ-direction, and the sloping surface 41 is a flat surface in parallel to the Y-direction but oblique to the Z-direction. However, the present invention is not limited thereto. For example, the sloping surface 41 may be a curved surface. Moreover, the facing surface 40 may not be provided, and the sloping surface 41 may be formed to slope forward and downward from an upper end of the first rear wall 38.

Figure 11:
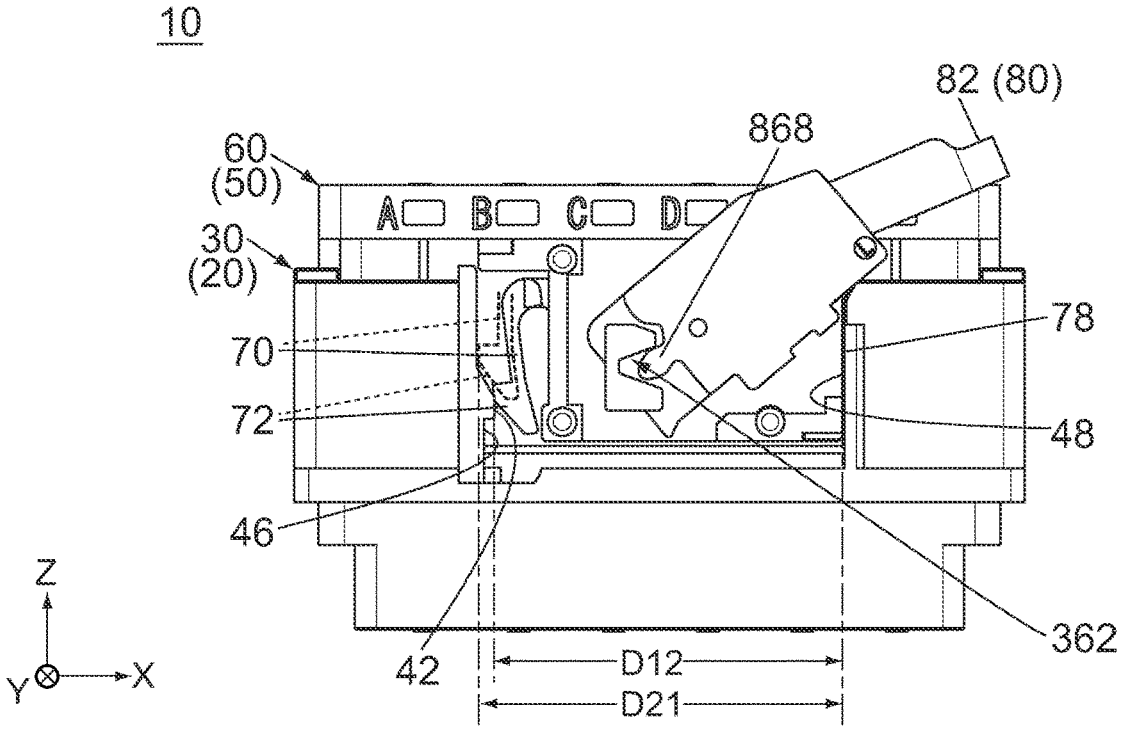
FIG. 11 is a side view showing the connector assembly of FIG. 10, wherein outlines of a spring portion and a locked portion under a state where the spring portion is not resiliently deformed are illustrated with dashed line.

Referring to FIG. 11, when the second connector 50 is further moved downward, the locked portion 72 rides on the slide surface 42 with a further resilient deformation of the spring portion 70 and then slides on the slide surface 42 to be moved downward. In other words, in the mating process of the second connector 50, the locked portion 72 slides on the slide surface 42 to be moved downward while being pressed against the slide surface 42 by a spring force of the spring portion 70.

Figure 12:
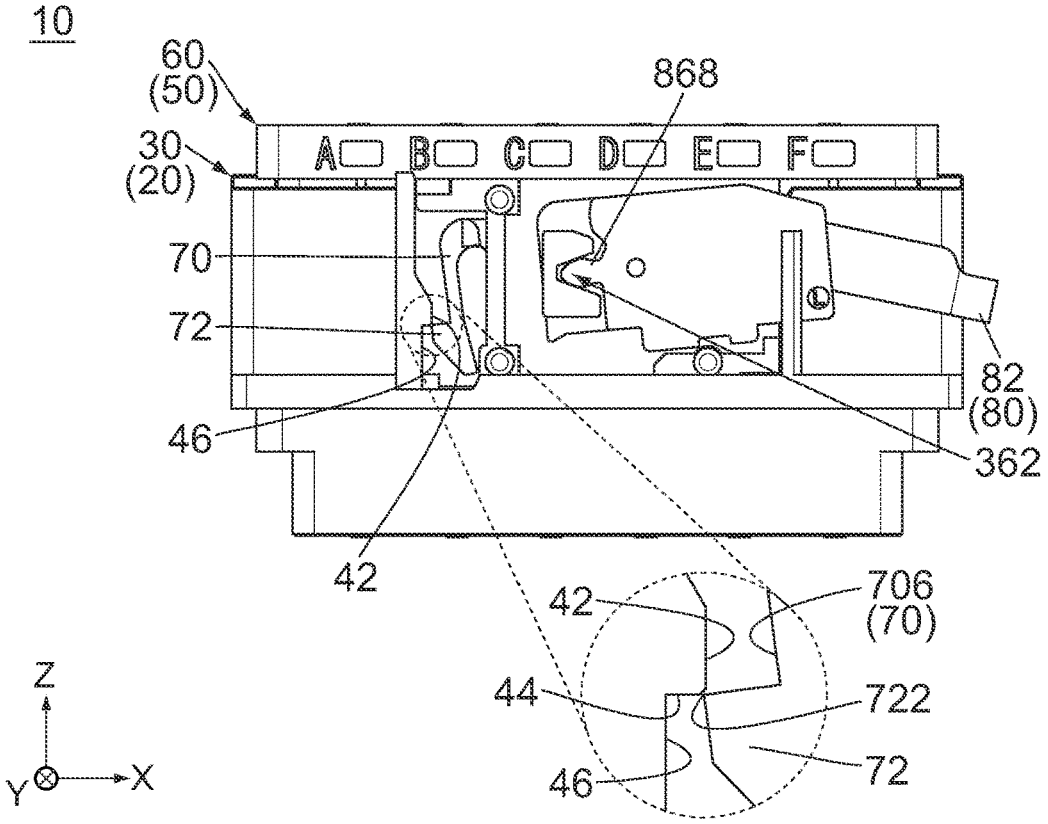
FIG. 12 is a side view showing the connector assembly of FIG. 11, wherein the second connector is mated with the first connector, and a part of the connector assembly enclosed by dashed line is enlarged and illustrated.
Figure 14:
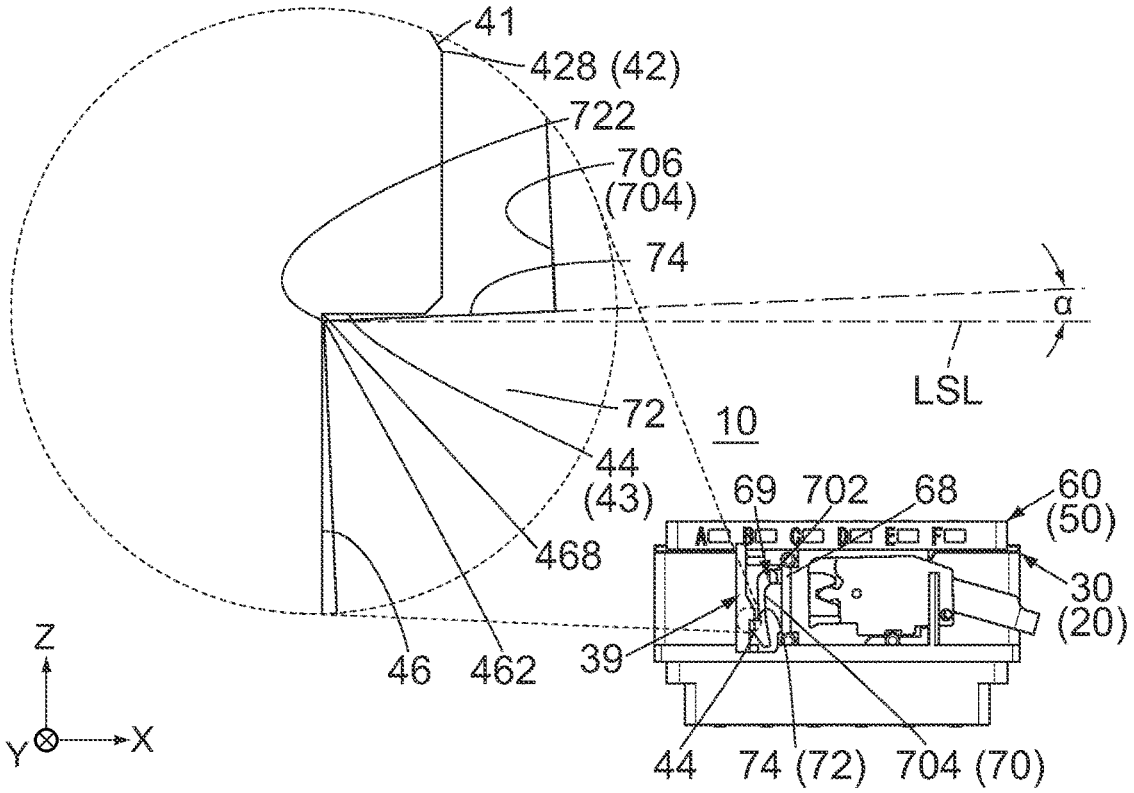
FIG. 14 is a side view showing the connector assembly of FIG. 13, wherein a part of the connector assembly enclosed by dashed line is enlarged and illustrated.

Referring to FIGS. 12 and 14, when the locked portion 72 is moved downward beyond the slide surface 42 in the mating process of the second connector 50, the locked portion 72 is strongly pushed toward the catch surface 46 by the spring force of the spring portion 70. Referring to FIG. 6, the lock surface 44 of the first connector 20 intersects with a line segment LS1 which extends straight upward from the lock surface 44 by a first angle θ1 of 90 degrees or less in the XZ-plane. In addition, when the second connector 50 is under the separated state, the locked surface 74 of the locked portion 72 intersects with a line segment LS2 which extends straight upward from the locked surface 74 by a second angle of 90 degrees same as the first angle θ1 in the XZ-plane.

Referring to FIG. 14, according to the aforementioned angle condition, the locked surface 74, which is moved downward beyond the slide surface 42, is moved toward the catch surface 46 with little or no friction on a lower end part of the slide surface 42. Meanwhile, since the support portion 704 extends upward from the locked portion 72, the locked portion 72 is moved in a substantially straight line along the X-direction. Thus, the locked portion 72 is rapidly moved rearward by the rearward spring force while receiving little or no forward force such as a friction force.

Referring to FIG. 6 together with FIG. 14, the first distance D11, which is a distance along the X-direction between the guide portion 48 and a first abutment portion 462 which is a part of the catch surface 46, is shorter than the second distance D21 which is a distance along the X-direction between the guided portion 78 and the leading edge (second abutment portion) 722 of the locked portion 72 of the second connector 50 under the separated state.

Referring to FIG. 14, the second abutment portion 722 of the locked portion 72, which is rapidly moved toward the catch surface 46, strikes the first abutment portion 462 of the catch surface 46 because of the aforementioned distance condition, and thereby a clear click sound is produced, and click feeling can be obtained.

Referring to FIG. 6, in the present embodiment, a first predetermined distance DP1 which is a distance along the X-direction between the slide surface 42 and the upper end 468 of the catch surface 46 is shorter than a second predetermined distance DP2 which is a distance along the X-direction between the lower end 708 of the support surface 706 and the leading edge 722 of the locked portion 72 of the second connector 50 under the separated state. However, the relation between the first predetermined distance DP1 and the second predetermined distance DP2 is not specifically limited, provided that the second abutment portion 722 of the locked portion 72 is brought into abutment with the first abutment portion 462 of the catch surface 46.

Referring to FIG. 14, under the mated state, the locked surface 74 is located below the lock surface 44. This arrangement locks the mated state. However, under the mated state, the fixed portion 702 of the spring portion 70 is located forward of the lock surface 44. The support portion 704 of the spring portion 70 extends from the fixed portion 702, which is located forward of the lock surface 44, to the locked portion 72 which is located below the lock surface 44. The thus-cantilevered spring portion 70 has a fulcrum which is a boundary portion between the fixing portion 68 and the fixed portion 702 and which is located above and forward of the locked surface 74. When the second connector 50 is pulled upward, the locked surface 74 receives an upward force from the lock surface 44, and thereby a forward moment about the fulcrum of the spring portion 70 is applied to the spring portion 70. As a result, the locked portion 72 is moved forward, and thereby the mated state is unlocked. Thus, according to the present embodiment, the second connector 50 is friction locked, and the mated state can be unlocked only by pulling the second connector 50 upward.

In particular, according to the present embodiment, the whole spring portion 70 is located forward of the lock surface 44 under the mated state. This structure makes the mated state to be easily unlocked. In addition, the locked surface 74 of the present embodiment extends toward the support portion 704 while sloping upward. In detail, the locked surface 74 intersects with a line segment LSL which extends forward from the locked surface 74 by an angle α of more than zero degree in the XZ-plane. When the second connector 50 is pulled upward, the locked surface 74 receives a forward force from the lock surface 44 to be moved forward. Thus, according to the present embodiment, the mated state can be further easily unlocked.

Referring to FIG. 6, in the present embodiment, the lock surface 44 is a flat surface perpendicular to the Z-direction, and the locked surface 74 under the separated state is a flat surface perpendicular to the Z-direction. However, the shape of each of the lock surface 44 and the locked surface 74 can be variously modified. For example, each of the lock surface 44 and the locked surface 74 under the separated state may be a flat surface in parallel to the Y-direction but oblique to the Z-direction. In detail, the first angle θ1 should be 90 degrees or less, and the second angle θ2 should be 90 degrees or less. Referring to FIG. 12, according to this angle condition, when the locked portion 72 is moved t downward beyond the slide surface 42 in the mating process, the locked portion 72 is rapidly moved rearward.

As previously described, the spring portion 70 of the present embodiment has an L-like shape in the XZ-plane. The spring portion 70 of an L-like shape moves the locked portion 72 rearward by a strong spring force when the locked portion 72 is moved downward beyond the slide surface 42. In addition, the spring portion 70 of an L-like shape is easily bent, and thereby the mated state can be further easily unlocked.

Referring to FIG. 14, the spring portion 70 of the present embodiment is a part of the second housing 60. In particular, the spring portion 70 is made of resin and is formed integrally with the second housing 60. The spring portion 70 made of resin is easily bent, and thereby the mated state can be easily unlocked even when the angle α is extremely close to zero, or when the angle α is 3 degrees or less, for example. However, the present invention is not limited thereto. For example, the spring portion 70 may be made of metal.

A structure for producing a clear click sound is not limited to that of the present embodiment but can be variously modified as describe below.

Figure 16:
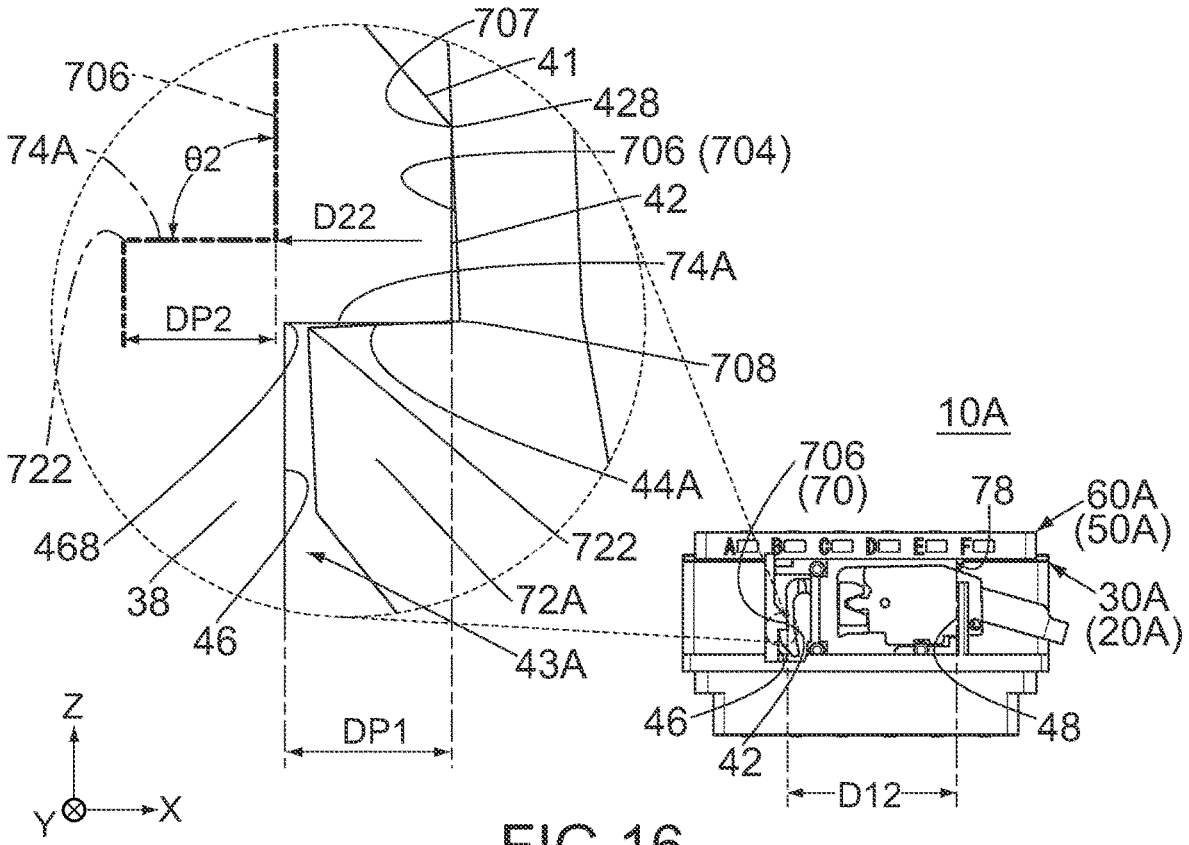
FIG. 16 is a side view showing a modification of the connector assembly of FIG. 14, wherein a part of the connector assembly enclosed by dashed line is enlarged and illustrated, and in the enlarged view, outlines of the spring portion and the locked portion under a state where the spring portion is not resiliently deformed are illustrated with two-dot chain line.

Comparing FIG. 16 with FIG. 14, a connector assembly 10A according to a modification of the present embodiment comprises a first connector 20A slightly different from the first connector 20 and a second connector 50A slightly different from the second connector 50. The first connector 20A comprises a first housing 30A slightly different from the first housing 30, and the second connector 50A comprises a second housing 60A slightly different from the second housing 60. The first housing 30A is provided with a receiving recess 43A and a lock surface (upper wall surface) 44A instead of the receiving recess 43 and the lock surface 44, and the second housing 60A is provided with a locked portion 72A and a locked surface (upper surface) 74A instead of the locked portion 72 and the locked surface 74. Except for these differences, the first connector 20A has a structure same as that of the first connector 20, and the second connector 50A has a structure same as that of the second connector 50.

In the present modification, the receiving recess 43A is recessed rearward by a distance larger than that of the receiving recess 43. As a result, the size of the lock surface 44A in the X-direction is larger than the size of the lock surface 44 in the X-direction. Moreover, the locked portion 72A projects rearward by a distance shorter than that of the locked portion 72. As a result, the size of the locked surface 74A in the X-direction is smaller than the size of the locked surface 74 in the X-direction.

Referring to FIG. 16 together with FIG. 6, in the present modification, the first predetermined distance DP1 which is a distance along the X-direction between the slide surface 42 and the upper end 468 of the catch surface 46 is longer than the second predetermined distance DP2 which is a distance along the X-direction between the lower end 708 of the support surface 706 and the leading edge 722 of the locked portion 72A of the second connector 50 under the separated state. In addition, the first other distance D12 which is a distance along the X-direction between the guide portion 48 and the upper end (first abutment portion) 428 of the slide surface 42 is shorter than the second other distance D22 which is a distance along the X-direction between the guided portion 78 and the second abutment portion 707, or a part of the support portion 704 of the second connector 50 under the separated state.

According to the aforementioned distance condition, when the locked portion 72A is rapidly moved rearward, the second abutment portion 707 of the support portion 704 strikes the first abutment portion 428 of the slide surface 42, and thereby a clear click sound is produced, and click feeling can be obtained.

According to the present modification, the first predetermined distance DP1 is longer than the second predetermined distance DP2, and the locked portion 72 is not brought into abutment with the catch surface 46. However, the present invention is not limited thereto. For example, the first predetermined distance DP1 may be equal to the second predetermined distance DP2. In this instance, the second abutment portion 707 of the support portion 704 of the spring portion 70 is brought into abutment with the first abutment portion 428 of the slide surface 42, and the leading edge (second abutment portion) 722 of the locked portion 72A, which is rapidly moved toward the catch surface 46, is also brought into abutment with the first abutment portion 462 (see FIG. 14) of the catch surface 46. As a result, a further clear click sound is produced. Thus, in the present modification, the first predetermined distance DP1 may be equal to or longer than the second predetermined distance DP2.

Moreover, the first connector 20A of the present modification does not need to comprise the catch surface 46. For example, the first rear wall 38 of the first housing 30 may be formed with a hole which passes through the first rear wall 38 in the X-direction instead of the receiving recess 43A. In this instance, the first predetermined distance DP1 cannot be defined. As can be seen from the explanation described above, the relation between the first predetermined distance DP1 and the second predetermined distance DP2 of the present modification is not specifically limited.

Referring to FIGS. 14 and 16, according to the aforementioned embodiment, the leading edge 722, i.e., a point or a line segment, of the locked portion 72 made of resin is brought into abutment with the catch surface 46 made of resin, and according to the aforementioned modification, the spring portion 70 made of resin is brought into abutment with the upper end 428, i.e., a point or a line segment, of the slide surface 42 made of resin. According to the aforementioned embodiment and modification, a clear click sound is produced even in an instance where the parts which strike each other are made of resin since the parts strike each other at an extremely small strike area. However, the present invention is not limited thereto, but the parts which strike each other may be made of metal.

Referring to FIGS. 6 and 16, according to the aforementioned embodiment and modification, each of the slide surface 42 and the catch surface 46 is a flat surface in parallel to the YZ-plane. According to these shapes, the first distance D11, which is a distance between the first abutment portion 462 (see FIG. 14) and the guide portion 48 along the X-direction, is equal to another distance, namely a catcher distance, between the catch surface 46 and the guide portion 48 along the X-direction, and the first other distance D12, which is a distance between the first abutment portion 428 (see FIG. 16) and the guide portion 48 along the X-direction, is equal to another distance, namely a slider distance, between the slide surface 42 and the guide portion 48 along the X-direction. Moreover, the first angle θ1 is an angle between the slide surface 42 and the lock surface 44.

However, the present invention is not limited to the aforementioned embodiment and modification. For example, each of the slide surface 42 and the catch surface 46 may be a sloping surface in parallel to the Y-direction but oblique to the Z-direction. In this instance, the catcher distance varies depending on the part of the catch surface 46, and the slider distance varies depending on the part of the slide surface 42. However, even in this instance, the first distance D11 is a distance between the first abutment portion 462 (see FIG. 14) and the guide portion 48 along the X-direction, and the first other distance D12 is a distance between the first abutment portion 428 (see FIG. 16) and the guide portion 48 along the X-direction.

According to the aforementioned embodiment and modification, under the separated state, the support surface 706 is a flat surface in parallel to the YZ-plane, and a rear edge surface, which includes the leading edge 722 of the locked portion 72 (locked portion 72A), is a flat surface in parallel to the YZ-plane. According to these shapes, the second distance D21, which is a distance along the X-direction between the second abutment portion 722 and the guided portion 78 under the separated state, is equal to another distance, namely a locker distance, along the X-direction between the guided portion 78 and the rear edge surface of the locked portion 72 (locked portion 72A) under the separated state, and the second other distance D22, which is a distance along the X-direction between the second abutment portion 707 and the guided portion 78 under the separated state, is equal to another distance, namely a supporter distance, along the X-direction between the support surface 706 and the guided portion 78 under the separated state. Moreover, the second angle θ2 is an angle between the support surface 706 and the locked surface 74.

However, the present invention is not limited to the aforementioned embodiment and modification. For example, each of the support surface 706 and the rear edge surface of the locked portion 72 (locked portion 72A) under the separated state may be a sloping surface in parallel to the Y-direction but oblique to the Z-direction. In this instance, the locker distance varies depending on the part of the rear edge surface of the locked portion 72 (locked portion 72A), and the supporter distance varies depending on the part of the support surface 706. However, even in this instance, the second distance D21 is a distance along the X-direction between the second abutment portion 722 and the guided portion 78 under the separated state, and the second other distance D22 is a distance along the X-direction between the second abutment portion 707 and the guided portion 78 under the separated state.

Referring to FIG. 16, according to the modification of FIG. 16, each of the slide surface 42 and the support surface 706 under the separated state is a flat surface perpendicular to the X-direction as described above. According to these shapes, the second abutment portion 707, which is a part of the support portion 704, is brought into abutment with the upper end 468 of the slide surface 42. However, the present invention is not limited thereto. For example, by forming one of the slide surface 42 and the support surface 706 under the separated state into a flat surface oblique to the X-direction, a part of the support portion 704 can be brought into abutment with a lower end of the slide surface 42.

Referring to FIGS. 14 and 16, according to the aforementioned embodiment and modification, the sloping surface 41 extends to the upper end 428 of the slide surface 42. In contrast, a boundary portion between the slide surface 42 and the lock surface 44 (lock surface 44A) is chamfered to be formed with a sloping edge. Thus, a lower end of the slide surface 42 and a front end of the lock surface 44 (lock surface 44A) are apart from each other. However, the present invention is not limited thereto. For example, the slide surface 42 may extend to the front end of the lock surface 44 (lock surface 44A).

According to the embodiment and modification, the lock surface 44 (lock surface 44A) is perpendicular to the Z-direction, and the receiving recess 43 (receiving recess 43A) is located only below the slide surface 42. However, the present invention is not limited thereto. For example, the lock surface 44 (lock surface 44A) may extend rearward and upward from the slide surface 42. In this instance, the receiving recess 43 (receiving recess 43A) is partially located above the slide surface 42, and the upper end 468 of the catch surface 46 is located above the lower end of the slide surface 42. Thus, the catch surface 46 should be, at least in part, located below the slide surface 42.

Summarizing the explanation described above, according to the aforementioned embodiment and modification, each of the first angle θ1, by which the lock surface 44 (lock surface 44A) intersects with the Z-direction, and the second angle θ2, by which the locked surface 74 (locked surface 74A) of the locked portion 72 (locked portion 72A) intersects with the Z-direction, is 90 degrees or less. Moreover, according to the aforementioned embodiment and modification, the locked portion 72 is located at a position so as to be brought into abutment with the catch surface 46, or the support portion 704 of the spring portion 70 is located at a position so as to be brought into abutment with the slide surface 42.

Referring to FIGS. 14 and 16, according to the aforementioned structure, even when a mating speed in the mating process is slow, the locked portion 72 (locked portion 72A) is rapidly moved rearward. Because of this rapid movement, the locked portion 72 strikes the catch surface 46 at high speed, or the support portion 704 strikes the slide surface 42 at high speed. As a result, a large click sound is produced even when the mating speed is slow, and the large click sound indicates that the first connector 20 (first connector 20A) and the second connector 50 (second connector 50A) have been mated with each other.

As described above, the present invention provides the connector assembly 10 comprising the lock mechanism which produces a large click sound even when the mating speed is slow and which enables the mated state to be unlocked with no additional operation.

Referring to FIG. 14, the structure of the connector assembly 10 can be further variously modified in addition to the already described modifications. Hereafter explanation will be made about some modifications of the first lock structure 39 of the first connector 20 and the second lock structure 69 of the second connector 50.

Figure 17:
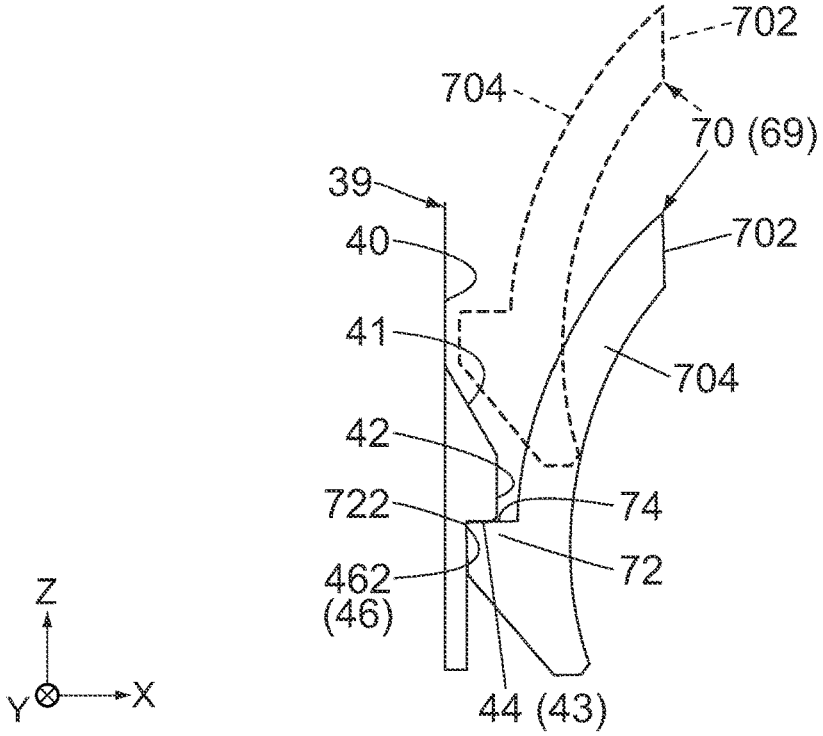
FIG. 17 is a side view showing a modification of a first lock structure and a second lock structure of the connector assembly of FIG. 14, wherein outlines of the spring portion and the locked portion under a state where the spring portion is not resiliently deformed are illustrated with dashed line.

As shown in FIG. 17, in the spring portion 70 of the second lock structure 69, the fixed portion 702 may be an edge surface, and the support portion 704 may extend in arc from the fixed portion 702. According to the illustrated modification, the second abutment portion 722 of the locked portion 72 is brought into abutment with the first abutment portion 462 of the catch surface 46. However, the support portion 704 can be brought into abutment with the slide surface 42 by shifting the position of the slide surface 42 forward in the X-direction, for example.

Figure 18:
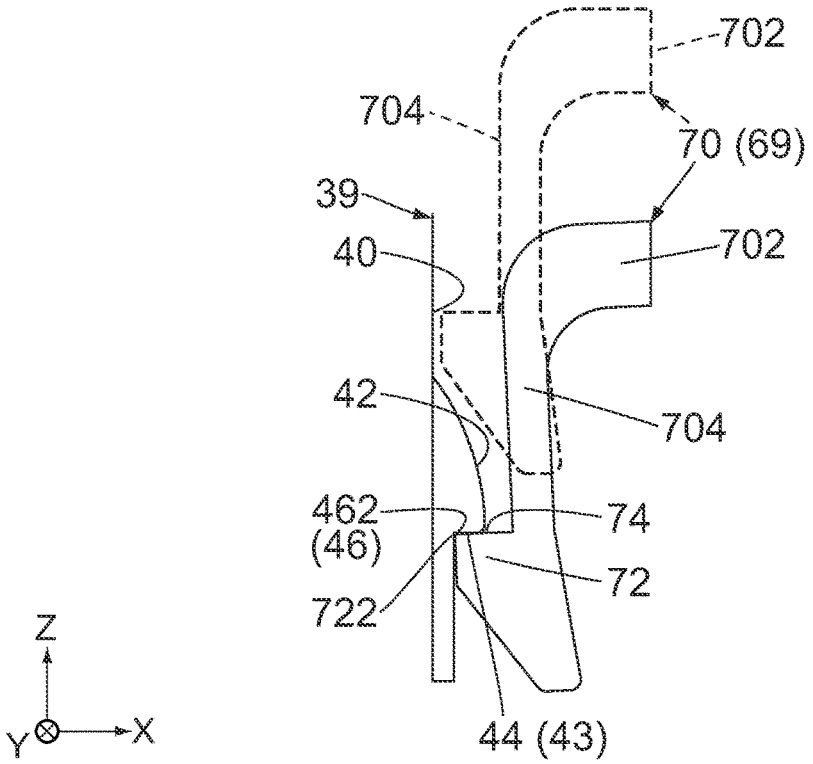
FIG. 18 is a side view showing another modification of the first lock structure and the second lock structure of FIG. 14, wherein outlines of the spring portion and the locked portion under a state where the spring portion is not resiliently deformed are illustrated with dashed line.

As shown in FIG. 18, in the first lock structure 39, the slide surface 42 may be a curved surface. According to the illustrated modification, the sloping surface 41 (see FIG. 17) is not provided, and the slide surface 42 extends from the facing surface 40. Moreover, according to the illustrated modification, the second abutment portion 722 of the locked portion 72 is brought into abutment with the first abutment portion 462 of the catch surface 46. However, the support portion 704 can be brought into abutment with the slide surface 42 by shifting the position of the lower end of the slide surface 42 forward in the X-direction, for example.

Figure 19:
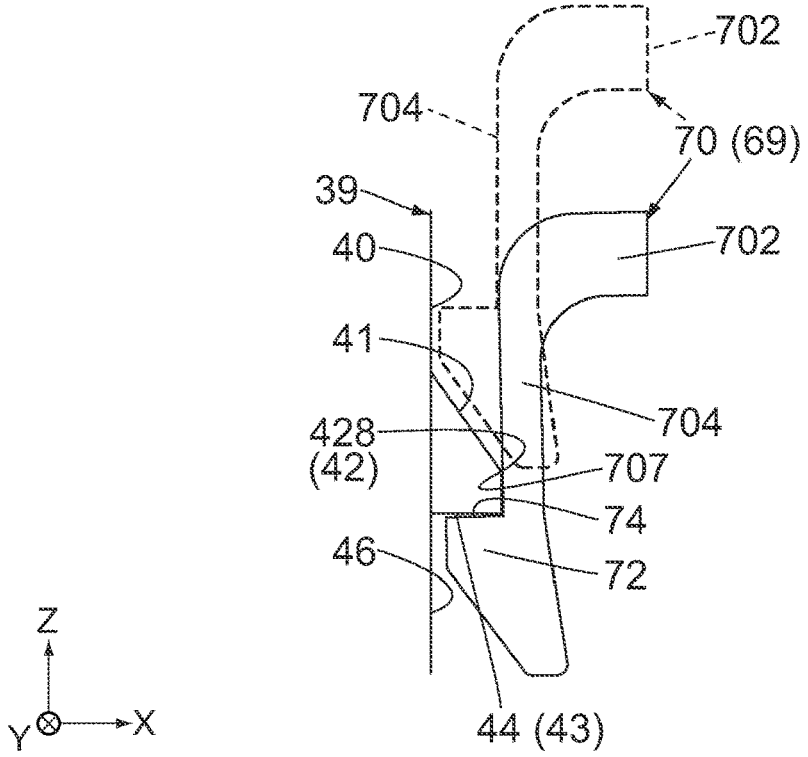
FIG. 19 is a side view showing still another modification of the first lock structure and the second lock structure of FIG. 14, wherein outlines of the spring portion and the locked portion under a state where the spring portion is not resiliently deformed are illustrated with dashed line.

As shown in FIG. 19, in the first lock structure 39, the catch surface 46 may be located at a position same as that of the facing surface 40 in the X-direction. According to the illustrated modification, the second abutment portion 707 of the support portion 704 is brought into abutment with the first abutment portion 428 of the slide surface 42. However, the locked portion 72 can be brought into abutment with the catch surface 46 by shifting the position of the slide surface 42 rearward in the X-direction, for example.

Figure 20:
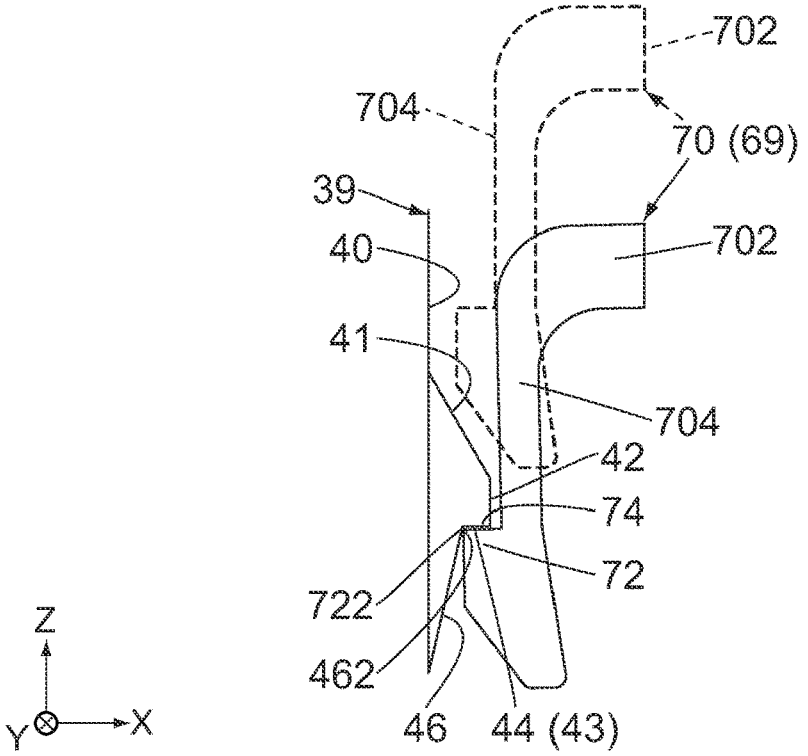
FIG. 20 is a side view showing yet another modification of the first lock structure and the second lock structure of FIG. 14, wherein outlines of the spring portion and the locked portion under a state where the spring portion is not resiliently deformed are illustrated with dashed line.

As shown in FIG. 20, in the first lock structure 39, the catch surface 46 may be a sloping surface. According to the illustrated modification, the second abutment portion 722 of the locked portion 72 is brought into abutment with the first abutment portion 462 of the catch surface 46. However, the support portion 704 can be brought into abutment with the slide surface 42 by shifting the position of the slide surface 42 forward in the X-direction, for example.

Figure 21:
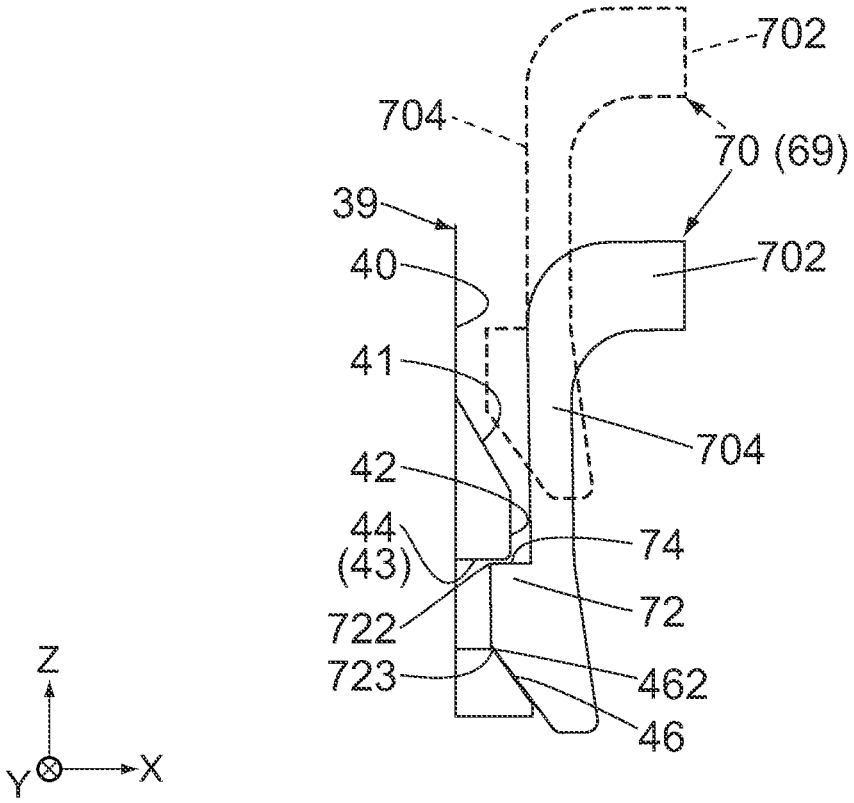
FIG. 21 is a side view showing further modification of the first lock structure and the second lock structure of FIG. 14, wherein outlines of the spring portion and the locked portion under a state where the spring portion is not resiliently deformed are illustrated with dashed line.
Figure 22:
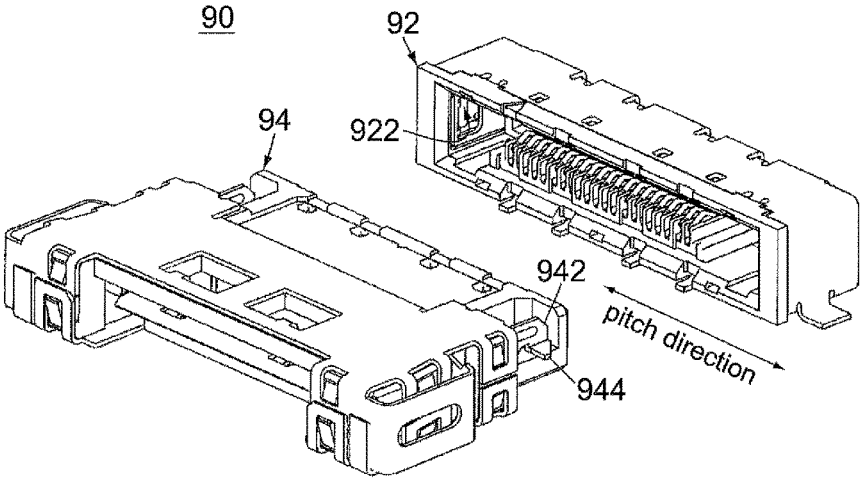
FIG.22 PRIOR ART
FIG. 22 is a perspective view showing a connector assembly of Patent Document 1.
Figure 23:
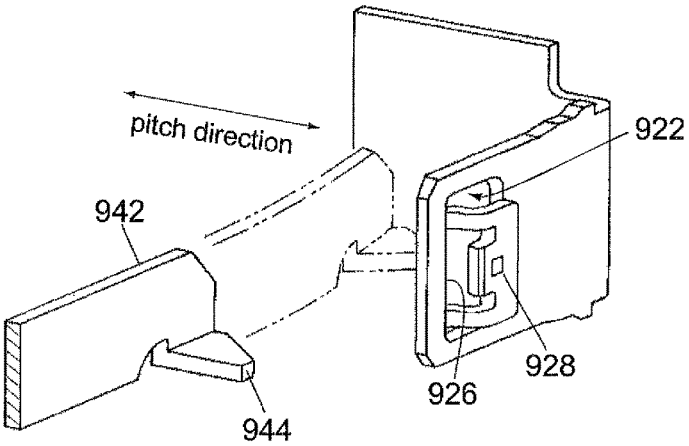
FIG.23 PRIOR ART
FIG. 23 is a perspective view showing a part of the connector assembly of FIG. 22.

As shown in FIG. 21, in the first lock structure 39, the catch surface 46 may be a sloping surface which is located below and apart from the lock surface 44. According to the illustrated modification, a part of the lock surface 44 is located rearward of the slide surface 42, and another part of the lock surface 44 is located forward of the slide surface 42. According to the illustrated modification, a second abutment portion 723 of the locked portion 72 which is located below the leading edge 722 is brought into abutment with the first abutment portion 462 of the catch surface 46. However, the support portion 704 can be brought into abutment with the slide surface 42 by shifting the position of the slide surface 42 forward in the X-direction, for example. Moreover, even in an instance where the whole catch surface 46 is located forward of the slide surface 42, the second abutment portion 723 of the locked portion 72 can be brought into abutment with the first abutment portion 462 of the catch surface 46 by changing the shape of the locked portion 72. According to this structure, the first predetermined distance DP1 (see FIG. 6) cannot be defined.

The present application is based on a Japanese patent application of JP2019-140748 filed on Jul. 31, 2019 before the Japan Patent Office, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10,10A connector assembly
12 first cable
14 second cable
20,20A first connector
22 first terminal
30,30A first housing
32 first peripheral wall
322 lever stopper
34 receiving space
36 first protruding wall
362 lever receiving portion
37 first side wall
38 first rear wall
39 first lock structure
40 facing surface
41 sloping surface
42 slide surface
428 upper end (first abutment portion)
43,43A receiving recess
44,44A lock surface (upper wall surface)
448 deep end
46 catch surface (rear wall surface)
462 first abutment portion
468 upper end
48 guide portion
50,50A second connector
52 second terminal
60,60A second housing
62 second peripheral wall
66 second side wall
68 fixing portion
69 second lock structure
70 spring portion
702 fixed portion
703 rear end
704 support portion
706 support surface
707 second abutment portion
708 lower end
72,72A locked portion
722 leading edge (second abutment portion)
723 second abutment portion
74,74A locked surface (upper surface)
78 guided portion
80 lever
81 operation member
82 operation portion
84 arm
86 operated member
862 rotation axis
868 projecting portion
88 cover

The invention claimed is:

1. A connector assembly comprising a first connector and a second connector, wherein:

the second connector is mateable with the first connector, which is located therebelow in an upper-lower direction, along the upper-lower direction;

the first connector comprises a first housing and one or more first terminals;

each of the first terminals is held by the first housing;

the first housing is provided with a slide surface, a lock surface, a catch surface and a guide portion;

each of the slide surface and the catch surface extends in the upper-lower direction;

the catch surface is, at least in part, located below the slide surface;

the lock surface has a deep end;

the deep end is located at a rear end of the lock surface in a front-rear direction perpendicular to the upper-lower direction;

the lock surface faces downward and extends from the deep end toward the slide surface in the front-rear direction;

the guide portion is located forward of the slide surface;

the second connector comprises a second housing and one or more second terminals;

each of the second terminals is held by the second housing;

the second housing is provided with a spring portion, a locked portion and a guided portion;

the spring portion has a fixed portion and a support portion and is resiliently deformable;

the fixed portion is fixed to a fixing portion of the second housing;

the support portion is connected to the fixed portion;

the locked portion projects rearward from the support portion;

the support portion extends upward from the locked portion;

the locked portion is movable in the front-rear direction in accordance with a resilient deformation of the spring portion;

the locked portion has a locked surface;

the locked surface is an upper surface of the locked portion which faces upward;

the guided portion is located forward of the spring portion;

in a mating process in which the second connector is mated with the first connector, the second connector is moved downward while the guided portion is guided by the guide portion;

in the mating process, the locked portion slides on the slide surface to be moved downward while being pressed against the slide surface;

the lock surface intersects with a line segment which extends straight upward from the lock surface by a first angle of 90 degrees or less in a perpendicular plane defined by the upper-lower direction and the front-rear direction;

when the second connector is under a separated state where the second connector is separated from the first connector, the locked surface intersects with another line segment which extends straight upward from the locked surface by a second angle of 90 degrees or less in the perpendicular plane;

when the locked portion is moved downward beyond the slide surface in the mating process, the locked portion is moved rearward, and a second abutment portion of the locked portion is brought into abutment with a first abutment portion of the catch surface;

a first distance D11, which is a distance along the front-rear direction between the first abutment portion and the guide portion, is shorter than a second distance D21 which is another distance along the front-rear direction between the second abutment portion and the guided portion of the second connector under the separated state; and under a mated state where the first connector and the second connector are mated with each other, the locked surface is located below the lock surface, and the fixed portion of the spring portion is located forward of the lock surface.

2. The connector assembly as recited in claim 1, wherein under the mated state, the locked surface extends and slopes toward the support portion.

3. The connector assembly as recited in claim 1, wherein under the separated state, the fixed portion of the spring portion extends rearward from the fixing portion of the second housing, and the support portion of the spring portion extends downward from a rear end of the fixed portion.

4. The connector assembly as recited in claim 1, wherein:

the first housing is provided with a sloping surface; and the sloping surface extends to the slide surface while sloping forward and downward.

5. The connector assembly as recited in claim 1, wherein the spring portion is made of resin and is formed integrally with the second housing.

6. A connector assembly comprising a first connector and a second connector, wherein:

the second connector is mateable with the first connector, which is located therebelow in an upper-lower direction, along the upper-lower direction;

the first connector comprises a first housing and one or more first terminals;

each of the first terminals is held by the first housing;

the first housing is provided with a slide surface, a lock surface and a guide portion;

the slide surface extends in the upper-lower direction;

the lock surface has a deep end;

the deep end is located at a rear end of the lock surface in a front-rear direction perpendicular to the upper-lower direction;

the lock surface faces downward and extends from the deep end toward the slide surface in the front-rear direction;

the guide portion is located forward of the slide surface;

the second connector comprises a second housing and one or more second terminals;

each of the second terminals is held by the second housing;

the second housing is provided with a spring portion, a locked portion and a guided portion;

the spring portion has a fixed portion and a support portion and is resiliently deformable;

the fixed portion is fixed to a fixing portion of the second housing;

the support portion is connected to the fixed portion;

the locked portion projects rearward from the support portion;

the support portion extends upward from the locked portion;

the locked portion is movable in the front-rear direction in accordance with a resilient deformation of the spring portion;

the locked portion has a locked surface;

the locked surface is an upper surface of the locked portion which faces upward;

the guided portion is located forward of the spring portion;

in a mating process in which the second connector is mated with the first connector, the second connector is moved downward while the guided portion is guided by the guide portion;

in the mating process, the locked portion slides on the slide surface to be moved downward while being pressed against the slide surface;

the lock surface intersects with a line segment which extends straight upward from the lock surface by a first angle of 90 degrees or less in a perpendicular plane defined by the upper-lower direction and the front-rear direction;

when the second connector is under a separated state where the second connector is separated from the first connector, the locked surface intersects with another line segment which extends straight upward from the locked surface by a second angle of 90 degrees or less in the perpendicular plane;

when the locked portion is moved downward beyond the slide surface in the mating process, the locked portion is moved rearward, and a second abutment portion of the support portion is brought into abutment with a first abutment portion of the slide surface;

a first other distance D12, which is a distance along the front-rear direction between the first abutment portion and the guide portion, is shorter than a second other distance D22 which is a distance along the front-rear direction between the second abutment portion and the guided portion of the second connector under the separated state; and under a mated state where the first connector and the second connector are mated with each other, the locked surface is located below the lock surface, and the fixed portion of the spring portion is located forward of the lock surface.

7. The connector assembly as recited in claim 6, wherein under the mated state, the locked surface extends and slopes toward the support portion.

8. The connector assembly as recited in claim 6, wherein under the separated state, the fixed portion of the spring portion extends rearward from the fixing portion of the second housing, and the support portion of the spring portion extends downward from a rear end of the fixed portion.

9. The connector assembly as recited in claim 6, wherein: the first housing is provided with a sloping surface; and the sloping surface extends to the slide surface while sloping forward and downward.

10. The connector assembly as recited in claim 6, wherein the spring portion is made of resin and is formed integrally with the second housing.

* * * * *